United States Patent [19]

Amick et al.

[11] Patent Number: 4,797,223

[45] Date of Patent: Jan. 10, 1989

[54] WATER SOLUBLE POLYMERS FOR DETERGENT COMPOSITIONS

[75] Inventors: David R. Amick, Doylestown; Charles E. Jones, Yardley; Kathleen A. Hughes, Blue Bell, all of Pa.

[73] Assignee: Rohm and Haas Company, Philadelphia, Pa.

[21] Appl. No.: 142,751

[22] Filed: Jan. 11, 1988

[51] Int. Cl.[4] ..... C11D 3/37

[52] U.S. Cl. ..... 252/174.23; 252/DIG. 2; 252/DIG. 15

[58] Field of Search ..... 526/211; 525/329.8; 252/174.23, DIG. 2

[56] References Cited

U.S. PATENT DOCUMENTS

| | | | |
|---|---|---|---|
| 3,308,067 | 3/1967 | Diehl | 252/161 |
| 3,557,065 | 1/1971 | Blumberg | 260/78.4 |
| 3,637,609 | 1/1972 | Blumberg | 260/78.4 |
| 3,676,373 | 7/1972 | Paviak | 252/531 |
| 3,692,704 | 9/1972 | Stamm | 252/525 |
| 3,706,672 | 12/1972 | Martin | 252/156 |
| 3,708,436 | 1/1973 | Thompson | 252/527 |
| 3,719,647 | 3/1973 | Mardy | 260/86.1 R |
| 3,733,280 | 5/1973 | Chakrabarti | 252/539 |
| 3,758,419 | 9/1973 | Hayden | 252/551 |
| 3,761,412 | 9/1973 | Lancelot | 252/550 |
| 3,775,475 | 11/1973 | Hulm | 260/535 P |
| 3,793,228 | 2/1974 | Kundler | 252/541 |
| 3,794,605 | 2/1974 | Diehl | 252/89 |
| 3,830,745 | 8/1974 | Tsukumi | 252/89 |
| 3,850,832 | 11/1974 | Wegemund | 252/99 |
| 3,853,781 | 12/1978 | Haschke | 252/132 |
| 3,865,793 | 2/1975 | Bruson | 260/78.5 R |
| 3,870,648 | 3/1975 | Grife | 252/135 |
| 3,883,446 | 5/1975 | McGuire | 252/545 |
| 3,896,086 | 7/1975 | Haschke | 260/67 UA |
| 3,904,685 | 9/1975 | Shahidi | 260/537 N |

*Primary Examiner*—Paul Lieberman
*Assistant Examiner*—Kathleen Markowski

[57] ABSTRACT

Detergent compositions include water soluble polymers which serve as builders, lime soap dispersants, and antiredeposition agents. The water soluble polymers, which fall into two structural classes, are especially useful in commerical heavy duty liquid detergent compositions, with which they are compatible in effective amounts. The water soluble polymers enhance several detergent properties such as antiredeposition and lime soap dispersants without a concomittant loss in other detergent composition characteristics. Further, the polymers are compatible with enzyme containing liquid detergents. In the first structural class surfactant radicals are distributed along the polymer chain, which also includes pendent carboxyl and/or carboxylate salt radicals. In the second structural class the polymers are terminated by a surfactant radical. The water soluble polymers are also effective dispersants for a number of particulate materials including kaolin clay and powdered coal, and inhibit the precipitation of calcium chloride and barium sulfate.

16 Claims, No Drawings

WATER SOLUBLE POLYMERS FOR DETERGENT COMPOSITIONS

BACKGROUND OF THE INVENTION

1. Field of the Invention

The present invention relates generally to water soluble polymers, as well as to detergent compositions containing these polymers, the preparation of the polymers and detergent compositions, and use of the polymers. More specifically, this invention relates to copolymers of polymerizable ethylenically unsaturated $C_3$–$C_6$ monocarboxylic acids and copolymerizable ethylenically unsaturated monomers including hydrophobic groups and polyalkyleneoxy groups, and to detergent compositions, especially heavy duty liquid detergent compositions for laundry and dishwashing use, and the use of the copolymers in these compositions.

2. Brief Summary of the Prior Art

The use of certain polycarboxylic acid compounds including polymeric polycarboxylic acid, and their salts, as additives in detergent compositions is known to enhance the efficiency of surfactants in wetting the substrate to be cleaned. These "sequestering builders" function by forming complexes with hard water ions, such as Calcium and magnesium, which otherwise inactivate anionic surfactants in the detergent composition. This insoluble material tends to deposit on fabric being washed, and interferes with the uptake of optical brighteners by the fabric from the wash water, resulting in dingy, unattractive fabric after washing. In addition to serving as a sequestering agent, a builder may also aid in keeping soil which has been removed by the washing process from redepositing on fabric being washed (antideposition agent) as well as to moderate the pH of the wash water (buffering agent). The multiple roles played by the builder during the cleaning process tend to make formulating a detergent Composition a difficult, trial-and-error process.

One type of polymeric polycarboxylic acid which is well known as a sequestering builder is hydrolyzed polymaleic anhydride. This type of builder is disclosed, for example, in U.S. Pat. Nos. 3,308,067, 3,557,005 and 3,676,373. Maleic anhydride copolymers and derivatives are also known in the art as detergent builders. For example, U.S. Pat. No. 3,794,605 discloses a built detergent composition including a mixture of water soluble salts of a cellulose sulfate ester and a copolymer of a vinyl compound and maleic anhydride. The builder enhances the "whiteness maintenance" of the detergent composition by preventing redeposition of soil and deposition of hardness ion builder salts on laundered fabrics. Water soluble salts of copolymers of a vinyl compound and maleic anhydride have also been used in detergent compositions. For example, U.S. Pat. No. 3,830,745 relates to water soluble salts of copolymers of maleic builder. Other maleic anhydride copolymers useful as builders include those prepared with styrene (U.S. Pat. No. 3,676,373), chloromaleic acid (U.S. Pat. No. 3,733,280), vinyl acetate or methyl methacrylate (U.S. Pat. No. 3,708,436), carbon monoxide (U.S. Pat. No. 3,761,412) tetrahydrophthalic anhydride (U.S. Pat. No. 3,838,113), as well as telomers with alkyl esters or alkylene carbonates (U.S. Pat. Nos. 3,758,419 and 3,775,475) and with vinyl alcohol (U.S. Pat. No. 3,793,228).

In a similar vein is U.S. Pat. No. 4,009,110 which discloses terpolymers of maleic anhydride, diketene, and vinyl alkyl ethers and their hydrolyzed derivatives as detergent builders and complexing agents, as well as the use of these terpolymers with the water soluble salts of higher molecular weight polycarboxylic acids, such as dicarboxylic acid polymers and copolymers with polymerizable monocarboxylic acids. U.S. Pat. No. 4,554,099 relating to an opaque general-purpose liquid cleaning composition discloses resin copolymers which are at least partially esterified with an alcohol, such as partially esterified adducts of rosin with maleic anhydride, and copolymers of maleic anhydride with vinyl methyl ether partially esterified with butanol. Streak-free liquid cleaners including similar copolymers are disclosed in U.S. Pat. No. 4,508,635. The use of partially hydrolyzed polymaleic anhydride as a component in a detergent composition adapted for washing textiles after they have been dyed is disclosed in U.S. Pat. No. 4,545,919.

U.S. Pat. No. 4,471,100 discloses copolymers of maleic acid salts and polyalkylene glycol monoallyl ether for use as dispersants in cements and mortars, inter alia. British patent specification No. 1,167,524 discloses similar copolymers, except that the polyalkyene glycol chain is capped by a monovalent aliphatic, cycloaliphatic, aryl aliphatic, aryl, alkylaryl, or acyl group, having at least four carbon atoms and that the polymerizable "surfactant monomer" can be derived from ethylenically unsaturated mono- or di- carboxylic acids as well as allyl-functional compounds.

Another invention in this tradition is that of U.S. Pat. No. 4,559,159 ("'159 patent"), which discloses copolymers of ethylenically unsaturated monocarboxylic and dicarboxylic acids (and their anhydrides, such as maleic anhydride) which are partially esterified with an alkoxylated ($C_1$–$C_{18}$)alkyl phenol. These copolymers are used as "detergent assistants" to replace traditional detergent builders such as polycarboxylic acids. These assistants simultaneously optimize the primary and secondary detergent action of the detergent in the composition.

The use of maleic anhydride in the '159 patent appears to be motivated by the purported ease of preparation of maleic anhydride copolymers, in that these copolymers can be prepared by simply first copolymerizing the acid monomers in an aqueous solution and then partially esterifying the intermediate polymer by reaction of the alkoxylated alkyl phenol with maleic anhydride, thus forming the monoester (Col. 5, lines 54–64). In addition, a neutralization step can be avoided by using a mixture of the soluble salt of dicarboxylic acid and a monocarboxylic acid, or a mixture of the soluble salt of a monocarboxylic acid and the dicarboxylic acid (Col. 8, lines 53–65). The '159 patent notes an advance ove the art which employed maleic anhydride/acrylic acid copolymers and methyl vinyl ether/maleic anhydride copolymers (items 4 and 5 in the table in Col. 16).

Another general type of polymeric polycarboxylic acid builder is polyacrylic acid. U.S. Pat. No. 3,706,672, for example, discloses sodium polyacrylate as a substitute for polyphosphate builder in household detergent compositions. High chelation value polyacrylic acid is disclosed in U.S. Pat. No. 3,904,685. The use of oligomeric (molecular weight 500–10,000) poly(alkyl)acrylic acids and their salts as biodegradable builders for detergent compositions is disclosed in U.S. Pat. No. 3,922,230. Similarly. U.S. Pat. No. 3,950,260 relates to water soluble homopolymers of acrylic acid and methacrylic acid and their salts as builders, the preferred degree of polymerization being fixed by a viscosity criterion. Crosslinked homopolymers of acrylic acid are disclosed to be suitable "structuring agents' for highly alkaline liquid detergent compositions in U.S. Pat. No. 3,566,504.

Copolymers of acrylic acid and other monomers are also known as builders. For example, copolymers of acrolein and acrylic acid are disclosed as builders in U.S. Pat. Nos. 3,853,781 and 3,896,086. Similar polymers are disclosed in U.S. Pat. No. 4,031,022 which relates to copolymers of acrylic acid and alpha-hydroxyacrylic acid and their water soluble salts and use as detergent builders. These copolymers are capable of suspending lime (calcium carbonate) to an extent which significantly exceed their stoichiometric capacity. U.S. Pat. No. 3,920,570 describes a process for sequestering ions by employing a water soluble salt of a poly-alpha-hydroxyacrylic acid as a sequestering polyelectrolyte. Salts of terpolymers derived from alkyl alcohol, sulfur dioxide and acrylic or methacrylic acid are disclosed as replacements for phosphorous containing builders in U.S. Pat. No. 3,883,446. U.S. Pat. No. 3,719,647 discloses copolymers of (meth)acrylic acid and polyethoxylated (meth)acrylic acid as "whiteness maintenance" agents in conventional tripolyphosphate-built granular detergents. Preferably, these copolymers have a molecular weight between 30,000 and 200,000.

The use of mixtures of polyacrylic acid and other polymers in detergent compositions is also known. For example, the use of mixtures of polyacrylic acid and another polymer, poly(N,N-dicarboxymethacrylamide), as a builder is disclosed in U.S. Pat. No. 3,692,704. Similarly, the use of mixtures of polyethylene glycol and polyacrylate in detergent compositions is disclosed in U.S. Pat. No. 4,490,271 to improve the removal of clay soils. The mixture is preferably used at relatively low levels, and a non-phosphorous detergent builder must also be included in these solid detergent compositions.

U.S. Pat. No. 4,571,303 discloses the use of water soluble polyacrylates to improve the storage stability of soil release promoting copolymers of polyethylene terphthalate-polyoxyethylene terphthalate in particulate nonionic detergent compositions.

European patent application 84115433.9 published July 10, 1985 discloses copolymers of acrylamido alkane sulfonic acid and copolymerizable ethylenically unsaturated esters of hydrocarboxy poly(alkenoxy)alkanol with acrylic and methacrylic acids as lime soap dispersants.

Despite the substantial advances which have been made in the cleaning arts in reducing the amount of water-eutrofying phosphate builder in detergent compositions, and in reducing redeposition of soil and sequestering hard water ions (lime soap dispersancy) during the washing process by use of water soluble polyions, there remains a substantial need for further improvement, particularly in liquid cleaning compositions. The need is especially acute when detergent compositions are used in laundering all-cotton fabrics, which are particularly susceptible to soil redeposition during the cleaning process. Recently, clothing made with all cotton and other natural fabrics has become increasingly popular.

Modern liquid laundry detergents for home laundering are complex, highly-engineered products. See, for example, S. C. Stinson, *Chemical and Engineering News,* Jan. 26, 1987, pp. 21–46 and U.S. Pat. No. 4,507,219 (heavy duty liquid detergent composition containing eleven components). The formulation of liquid laundry detergent composition is a highly unpredictable process, given the complex variety of interactions possible among the multiple components of these products and the critical importance of surface phenomena in the cleaning process. There is a need for a product which can serve both as an antideposition agent in lime soap dispersants and which is not only compatible with the highly-complex liquid detergent compositions presently being marketed to the consumer, but which also functions without diminishing other important performance characteristics of the detergent compositions.

SUMMARY OF THE INVENTION

The present invention provides novel water soluble polymers and dispersants, and detergent compositions containing the same, and a process for the preparation of one class of these polymers. The water soluble polymers are useful as additives in detergent compositions in whiCh they can serve as builders, lime soap dispersants by sequestering "hard water" cations (e.g. $Ca^{++}$), and as antiflocculants for soil (anti-redeposition agents). The water soluble polymers are of particular value in liquid detergent compositions, such as commercial home liquid laundry detergent compositions (heavy duty liquid detergents) and liquid dishwashing products (light duty liquid detergents). In heavy duty liquid detergent compositions the polymers of the present invention provide a significant enhancement in the ability of the detergent composition to resist the redeposition of particulate soil, especially when cotton fabric is being laundered. This enhancement is obtained over a range of water hardness (20–120 ppm $Ca^{++}$; 50–300 ppm as $CaCO_3$). In addition, the removal of oily soil (such as sebum from perspiration) is also enhanced.

It is especially significant that these enhancements in important detergent composition performance properties are obtained without significant corresponding deterioration in other properties. In comparison with commercial detergent controls which do not contain the polymers of the present invention, liquid detergent compositions of this invention retain the ability to effectively remove particulate soil, and the ability to prevent redeposition of oily soil. Further, when added in effective amounts the polymers are compatible with commercial heavy duty liquid detergent compositions. In contrast to phosphate builders, the polymers of the present invention do not adversely affect the activity of enzymes in liquid detergent compositions, opening the door to enzyme-containing liquid detergent products. The water soluble polymers of this invention can be grouped into two broad classes based on the structure of the polymer and reflecting the preparative method employed. The first class includes polymers with structures that can be represented by the formula $$A\ (B)_m\ (C)_n\ (D)_o\ E. \qquad (I)$$

This class of polymers has pendent "surfactant" radicals distributed along the polymer chain. In formula I, A and E are I5 terminal groups, and B, C and D are internal covalently bonded groups which can be arranged in any sequence. The subscript m is a positive integer and the subscripts n and o are nonnegative integers. The polymer has a number average molecular weight from about 500 to 50,000; preferably from about 1,000 to 15,000.

In formula I, A is a group selected from $R^b$—C(O)—$R^a$— and $R^c$—C(O)—NH—$R^d$—. Here $R^a$ is ($C_2$—$C_5$)alkylidene and $R^b$ is selected from —OQ and $R^c$, where Q in turn is selected from H and the positive ions forming soluble salts with carboxylate ions.

$R^c$ is a surfactant radical which has the formula $$R^1 Z (X^1)_a (X^2)_b— \quad (II)$$

where $R^1$ is preferably a hydrocarbyl group preferably selected from ($C_1$-$C_{18}$)alkyl, ($C_1$-$C_{18}$)alkenyl, and ($C_1$-$C_{18}$)alkaryl. Z is selected from —O—, —S—, —$CO_2$—, —$CONR_2$—, and —$NR^2$—. $X^1$ and $X^2$ are alkyleneoxy groups; $X^1$ is —$CH_2CH_2O$— and $X^2$ is —$C(CH_3)HCH_2O$—. The subscript a is a positive integer and the subscript b is a non-negative integer, the sum of a and b being from 3 to about 100. The alkyleneoxy groups $X^1$ and $X^2$ can be arranged in any sequence. For example, they can be arranged in alternating blocks. Alternatively, they can be ordered in a random sequence resulting from copolymerization of alkylene oxide monomers, the average properties reflecting the statistics of that reaction.

$R^2$ is selected from H, ($C_1$-$C_4$)alkyl and $H(X^1)_d(X^2)_e$—. Here d and e are nonnegative integers; the sum of d and e being from 1 to about 100. $R^d$ is simply a group which includes a carbon-carbon single bond formed during polymerization of the polymer from a carbon-carbon double bond. Preferably $R^d$ is the residue of an ethylenically unsaturated compound bearing a carbamate group.

In formula I, B is $$—\overset{|}{R^e}—C(O)—OQ$$

where $R^e$ is a saturated trivalent aliphatic radical containing from two to five carbon atoms. Unless otherwise stated, in this specification and claims "alkenyl" denotes a saturated trivalent aliphatic radical. The B groups are derived from polymerization of ethylenically unsaturated $C_3$-$C_6$ monocarboxylic acids, such as acrylic acid, and their soluble salts. Acrylic acid is preferred.

C in formula I is selected from $$—\overset{|}{R^e}—R^c,\ —\overset{|}{R^e}—C(O)—R^c,\ \text{and}\ —\overset{|}{R^f}—NHC(O)—R^c$$

where $R^f$, like $R^d$ in the A group, is a group which includes a carbon-carbon single bond formed during polymerization of the polymer from a polymerizable carbon-carbon double bond. It is also preferably the residue of a polymerized ethylenically unsaturated compound bearing a carbamate group.

D in formula I has the formula $$—\overset{|}{R^e}—G$$

where G is an organic group excluding —$CO_2Q$ and $R^c$.

E in formula I is a group selected from $R^c$—$R^g$—, $R^b$—C(O)—$R_g$—, and $R^c$—C(O)—$NHR^d$—, where Rg is a ($C_2$-$C_5$)alkylene group; that is, $R^g$ is a saturated bivalent aliphatic radical having from two to five carbon atoms.

In formula I m is selected such that $(B)_m$ comprises from about 20 to 95 percent by weight of the polymer; and n is selected such that $R^c$ comprises from about 80 to 4 percent by weight of the polymer. Further, o is selected such that $(D)_o$ comprises from 0 to about 30 percent by weight of the polymer, the sum of the weight percentage of A, $(B)_m$, $(C)_n$, $(D)_o$, and E being 100%.

A second class of polymers of the present invention are terminated with surfactant radicals, and can be represented by the formula L-J. L in this formula is a group having the formula $R^c$—C(O)$(CHR^3)_c$—S—, $R^c$ having been given above, $R^3$ being selected from H, $CH_3$— and $C_2H_5$— and subscript c being 1, 2 or 3.

Group —J in this formula has the formula —$(B)_m(D)_oE$ where B, D, E, m and o are given above. The weight ratio of L to J is from about 1:340 to 7:1, with 1:100 to 2:1 being preferred, 1:50 to 1:1 more preferred, and 1:10 to 1:2 especially preferred.

An especially preferred process for preparing the first class of water soluble polymers of the present invention is the "in process functionalization" (IPF) process disclosed in U.S. patent application Ser. No. 142,102, filed Jan. 11, 1988, and commonly assigned with the present application. Alternatively, any of several other preparative methods can be used. In one method, ethylenically unsaturated monomers are copolymerized by conventional techniques to give directly polymers having formula (I). In another method, an initial polymerization step is followed by an esterification or transesterification step.

The water soluble copolymers of the second class are preferably prepared by a novel process. In this process a mercaptan having the formula $$R^1Z(X^1)_a(X^2)_b—C(O)(CHR^3)_c—SH \quad (III)$$

is initially prepared. In formula III, c is 1, 2 or 3, R3 is H, $CH_5$ or $C_2H_5$—), and $R^1$, Z, $X^1$, $X^2$, a and b are given above. The mercaptan can be prepared by esterification of a mercapto acid having the formula HOC(O)$(CH_2)_c$SH with an alcohol of the formula $R^1Z(X^1)_a(X^2)_b$OH. Preferably, 3-mercaptopropionic acid is used. Alternatively, the mercaptan can be prepared by transesterification of a mercapto ester with $R^1Z(X^1)_a(X^2)_b$OH. In this process the mercaptan is used as a chain transfer agent in a subsequent polymerization of ethylenically unsaturated monomers including at least one ethylenically unsaturated carboxylic acid having 3-5 carbon atoms, preferably acrylic acid.

As noted above, the water soluble polymers of the present invention Can be used as builders in detergent compositions, and are especially useful in liquid detergent compositions, in particular commercial heavy duty liquid detergent compositions. The polymers provide a surprising and unexpected enhancement in detergent performance over prior art builders, including those based on maleic anhydride, when used in heavy duty liquid detergent compositions.

DETAILED DESCRIPTION

The water soluble polymers of the present invention include two broad structural classes. The polymers in these classes share several important characteristics. First, both groups of polymers are prepared from monomer including polymerizable ethylenically unsaturated $C_3$–$C_6$ monocarboxylic acids and their salts, such as acrylic acid and sodium acrylate. Second, the polymers must include a "surfactant" radical containing a hydrophobic group, for example a ($C_1$–$C_{18}$)hydrocarbyl group, linked to a polyalkyleneoxy group. Depending on the preparative process employed, this radical can comprise a portion of a polymerizable ethylenically unsaturated "surfactant monomer" which is copolymerized with the acid and/or acid salt comonomer, or the radical can comprise a portion of an alcohol used to esterify or transesterify a polymer including carboxylic acid and/or carboxylic acid ester radicals. As a third alternative, the radical can comprise a portion of a mercaptan-functional chain transfer agent used in polymerizing monomer including ethylenically unsaturated $C_3$—$C_6$ carboxylic acid and/or salts of such mnomer. The water soluble copolymers of the present invention are structurally distinguished from those disclosed, for example, in U.S. Pat. No. 4,559,159 in that polymerizable ethylenically unsaturated dicarboxylic acids and their respective salts and anhydrides are essentially excluded from the monomer compositions which are polymerized to prepare the water soluble polymers of this invention. They are functionally distinguished by, inter alia, their superior performance in liquid detergent compositions.

In addition to residues of polymerizable ethylenically unsaturated monocarboxylic acids and surfactant radicals, the water soluble polymers of the present invention can include residues of 'carboxylate-free" monomers. By "carboxylate-free" monomer is meant an ethylenically unsaturated copolymerizable monomer which does not include pendent carboxylic acid and/or carboxylate salt functionality. An example of a presently preferred carboxylate-free monomer is ethyl acrylate. Typically, the carboxylate-free monomer is copolymerized with the monocarboxylic acid and/or monocarboxylic acid salt monomer. A "carboxylate-free" monomer can include a surfactant radical, such as in the case of an allyl ether-functional surfactant monomer.

The water soluble polymers of the first structural class of this invention share a common structural feature. The surfactant radical can be positioned at any site along the "backbone" of the polymer chain, the "backbone" being viewed as made up of a sequence of alkylene groups which can have pendent carbonyl radicals. The surfactant radicals are thus covalently linked to one or more sites along the interior of the polymer chain. As discussed below, a number of different processes can be used to prepare the water soluble polymers in this class.

Water soluble polymers in the second structural class of the polymers of the present invention must have a surfactant radical at one terminus of the polymer chain. Polymers in this structural class are typically prepared by including a chain transfer agent bearing the surfactant radical in the polymerization reaction mixture. The polymerization of individual polymer molecules is terminated by the chain transfer agent. The chain transfer process results in the surfactant radical being covalently linked to the terminus of the polymer chain.

As noted above, the water soluble polymers of the first class can be represented by the formula $A(B)_m(C)_n(D)_oE$ wherein it is understood that the B, C, and D groups or radicals can be arranged in any sequence. The terminal A group is preferably selected from $R^b$—C(O)—$R^a$— and $R^cC(O)NH$—$R^d$—. However, it is understood that depending on the polymerization method and the initiator system employed the A group may include a fragment of the initiator or another element of the initiator system. $R^a$ is a ($C_2$–$C_5$) alkylidene group. For example, A can be ethylidene or propylidene.

$R^c$ is a group having the formula $R^1Z(X^1)a(X^2)_b$—. This "surfactant radical," like surfactant compounds, includes both a hydrophobic portion and a hydrophilic portion. $R^1$, the hydrophobic portion, is preferably a ($C_1$–$C_{18}$)hydrocarbyl group, preferably selected from ($C_1$–$C_{18}$)alkyl, ($C_1$–$C_{18}$)alkaryl, and ($C_1$–$C_{18}$)arakyl. Examples of ($C_1$–$C_{18}$)alkyl groups include methyl, t-butyl, n-octyl, hexadecyl and octadecyl. Examples of ($C_1$–$C_{18}$)alkaryl groups include octaphenyl, nonylphenyl and tolyl. Examples of ($C_1$–$C_{18}$)aralkyl groups include benzyl. Z is a group linking the hydrophobic and hydrophilic portions of the surfactant radical $R^c$. Z is preferably selected from —O—, —S—, —$CO_2$—, —$CONR^2$—, and —$NR_2$—. More preferably, Z is —O—. $R^2$ is selected from H, ($C_1$–$C_4$)alkyl, and $H(X^1)_d(X^2)_e$— where d and e are non-negative integers and the sum of d and e is from 1 to about 100. The hydrophobic portion can also be poly(alkylene oxy) where the alkylene portion is selected from propylene and higher alkylene.

The hydrophilic portion of the surfactant radical includes a poly(alkyleneoxy) chain, $(X^1)^a(X^2)_b$, where $X^1$ is —$CH_2CH_2O$— (ethyleneoxy) and $X^2$ is alkyleneoxy other than ethyleneoxy, and is preferably —$C(CH_3)HCH_2O$— (propyleneoxy). Here, a is a positive integer and b is a non-negative integer and the sum of a and b is from 3 to about 100. It is understood that the $X^1$ and $X^2$ units can be arranged in any sequence. For example, the sequence can reflect the statistics of the copolymerization of a mixture of ethylene oxide and propylene oxide. Alternatively, the ethyleneoxy unit and propyleneoxy units can be arranged in blocks, reflecting, for example, sequential homopolymerization of ethylene oxide and propylene oxide.

Q is selected from H and the positive ions which form soluble salts with carboxylate anions. For example, Q can be an alkali metal ion such as $Na^+$ or $K^+$, or ammonium or tetra-alkyl ammonium, such as tetramethylammonium. The pH of the polymerization medium can be adjusted by addition of an alkali metal base, such as sodium or potassium hydroxide. The strong base reacts with carboxylic acid to form alkali metal carboxylic salt.

$R^d$ is a group which includes a carbon-carbon single bond formed during polymerization of the polymer from a polymerizable carbon-carbon double bond. Preferably, $R^d$ is the residue of a polymerizable ethylenically unsaturated compound including a urethane group. The surfactant radical $R^c$ is linked to the $R^d$ group through the carbamate group, this carbamate group being understood to include the terminal oxygen atom of the alkylene oxide chain.

The structure of the A group can depend on the nature of the free radical initiating the vinyl addition of the polymer chain. In general, the A group, and the E group, can include a fragment of a polymerization initiator or chain transfer agent. The nature of these fragments or endgroups is well known in the polymerization arts. A variety of endgroups can be introduced through different polymerization processes. These polymerization procedures are well known. For example, A can include the following for mercaptan chain transfer polymerization processes: alkyl or aryl sulfide (introduced by use of alkyl or aryl mercaptans), carboxylic acid functional sulfides (introduced by use of mercaptocarboxylic acids), ester sulfides (introduced by use of mercaptocarboxylate ester compounds). Post-polymerization oxidation of the sulfide endgroups described above can result in sulfoxide and/or sulfone endgroups. If an alcohol, such as isopropanol, or benzyl alcohol is used as a chain transfer agent, endgroups which include alcohols or lactones may result. In addition, chain transfer solvent such as cumene, with a resultant alkyl aromatic endgroup, can be used. Molecular weight control using different initiators in the absence of a chain transfer solvent can result in a variety of A groups. For example, if perphosphates or persulfates are used phosphate or sulfate endgroups can result. If hydrogen peroxide is used the resultant endgroups are hydroxyl. Use of t-butyl peresters will result in ether or alkane endgroups.

In sum, the terminal group A is either a group having a single pendent carboxylic acid or acid salt, or a pendent surfactant radical linked to the backbone of the polymer chain through an ester or carbamate group.

B is a group having the formula $$-\overset{|}{R^e}-C(O)-OQ,$$

where $R^e$ is a trivalent-saturated aliphatic radical having two to five carbon chains. Examples of $R^e$ radicals include $$-CH_2-\overset{|}{CH}-,\ -CH(CH_3)-\overset{|}{CH}-,$$

$$-C(CH_3)_2-\overset{|}{CH}-,\ \text{and}\ -CH_2-\overset{|}{C}(CH_3)-.$$

Thus, the B group is a residue of an ethylenically unsaturated $C_3$–$C_6$ monocarboxylic acid or its water soluble salt.

C is a group selected from $$-\overset{|}{R^f}-NHC(O)-R^c,\ -\overset{|}{R^e}-R^c,\ \text{and}\ -\overset{|}{R^e}-C(O)-R^c.$$

The C group includes a pendent surfactant radical $R^c$ which can be linked to the interior of the polymer chain through an ester group, a carbamate linkage, a urethane group, or the like. Alternatively, the surfactant radical can be linked to the "backbone" of the polymer chain through carbon-carbon bonds, as when the C group is derived from polymerization of an allyl- or vinyl-functional surfactant monomer. Here $R^f$ is a trivalent saturated aliphatic group which includes a carbon-carbon single bond formed during polymerization of the polymer from a polymerizable carbon-carbon double bond. Preferably, $R^f$, like $R^d$, is derived from the polymerization of an ethylenically unsaturated carbamate-functional monomer.

D is a group having the formula $$-\overset{|}{R^e}-G$$

wherein G is an organic group which does not contain $-CO_2Q$ or $R^c$. D is thus the residue of a "carboxylate-free" ethylenically unsaturated polymerizable monomer, such as ethyl acrylate or methyl methacrylate.

E is preferably a bivalent saturated aliphatic radical having two to five carbon chains, that is, group selected from $R^c-R^g$, $R^b-C(O)-R^g-$ and $R^c-C(O)NH-R^d-$, where $R^g$ is ($C_2$–$C_5$)alkylene. E thus represents the group at the end of the polymer chain at which polymerization was terminated. Examples of $R^g$ radicals include $-CH_2-CH_2-$, $-CH(CH_3)-CH_2-$, $-CH(C_2H_5)-CH_2-$ and $-CH_2-CH(CH_3)-$. The E group can also include radicals associated with the chain termination step such as fragments of chain transfer agents and the like.

In the general formula for this first class of water soluble polymers m is a positive integer and n and o are non-negative integers. The value of m is selected such that the residues of ethylenically unsaturated $C_3$—$C_6$ monocarboxylic acid and/or water soluble salts of such acids, $(B)_m$, comprise from about 20 to 95 percent be weight of the polymer. The value of n is selected such that the surfactant radical, $R^c$, comprises from about 80 to 5 percent by weight of the polymer. The value of o is selected such that the residues of carboxylate-free monomer, $(D)_o$, comprise from 0 up to about 30 percent by weight of the polymer. The sum of the weight percentages of A, (B)m, (C)n, $(D)_o$ and E is 100%. The polymer has a number average molecular weight from about 500 to 50,000.

An example of a polymer which is represented by formula (I) is the polymer having the structural formula:

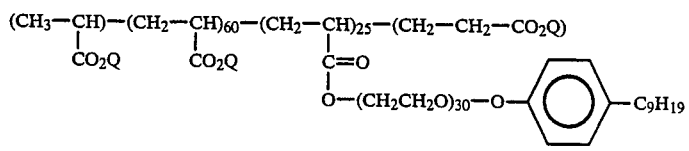

in which A, being selected to $R^b-C(O)-R^a-$, is $$(CH_3-\overset{|}{CH})-,$$

$R^a$ being ethylidene, $$(CH_3-\overset{|}{CH}-),$$

and $R^b$ being —CQ; similarly B, being selected to be $$-\overset{|}{R^e}-C(O)-OQ,\ \text{is}\ -(CH_2-\underset{|}{\underset{CO_2Q}{CH}})-,$$

$R^e$ being "ethenyl," i.e.,

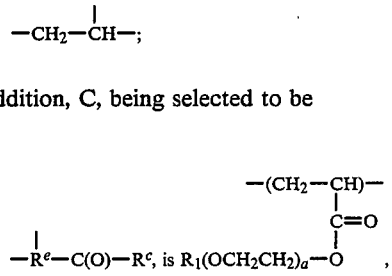

in addition, C, being selected to be $R^e$ being "ethenyl,"

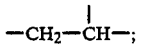

$R^c$ being

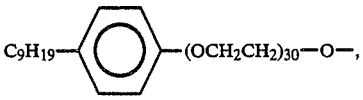

where $R^1$ is nonylphenyl, Z is O, $X^1$ is $(CH_2CH_2O)$, and a is 30; finally E, being selected to be $R^b$—C(O)—$R^g$—, is —($CH_2$—$CH_2$—$CO_2Q$), Rg is ethylene, —$CH_2$—$CH_2$—; and $R^b$ is —OQ. In this example, the sixty B units and twenty five C units are randomly distributed in the chain.

A second example of a polymer represented by formula (I) is the polymer having the structural formula:

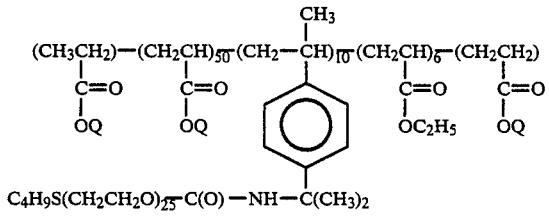

Here A, B and E are as in the first polymer above, and C, being selected to be

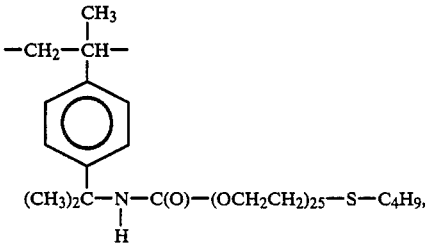

where $R^f$ is

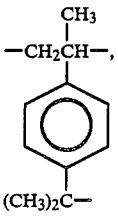

$X^1$ is $CH_2CH_2O$; Z is S; and $R^1$ is $C_4H_9$; and D, being selected to be

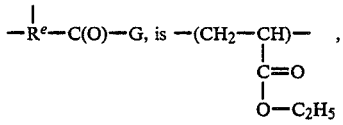

where

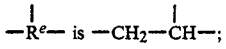

and

G is $OC_2H_5$, ethoxy. In this second example, the fifty B units, the ten C units, and the six D units are randomly distributed in the polymer chain, the distribution being governed by the monomer reactivity ratios.

The polymers of the first class of the present invention may be prepared by any of a variety of processes, including conventional aqueous solution vinyl polymerization processes. However, polymers are preferably prepared by the in process functionalization polymerization process disclosed in copending U.S. patent application Ser. No. 142,102, filed Jan. 11, 1988, and commonly assigned with the present application.

The water soluble polymers of the first class of the present invention can be prepared by any conventional polymerization technique, such as solution polymerization. For example, these polymers can be prepared by polymerization of monomers dissolved in an aqueous solvent. Both batch and continuous processes can be used. Among batch processes, both single and multiple shot as well as gradual addition processes can be used.

Conventional means for initiating the polymerization of ethylenically unsaturated monomers, including both thermal and redox initiation systems, can be used. Water soluble initiators are preferred. In addition, conventional means of controlling the average molecular weight of the polymer, such as by the inclusion of chain transfer agents in the polymerization reaction mixture, can be used. Examples of chain transfer agents which can be used include mercaptans, polymercaptans, and polyhalogen compounds. More specifically, chain transfer agents including long chain alkylmercaptans such as n-dodecyl mercaptan; alcohols such as isopropanol and isobutanol, and halogens such as carbon tetrachloride, tetrachloroethylene and trichlorobromoethane, can be used. Generally from 0 to about 20% by weight, based on the weight of the monomer mixture employed, and depending on the polymer molecular weight which is sought, can be used. However, when the solvent also functions as a chain transfer agent, as in the case of alcohols such as isopropanol, a substantially greater proportion of solvent chain-transfer agent can be used (for example, greater than 100% based on the weight of the monomer mixture). The amount of chain transfer agent used is selected to provide a number average polymer molecular weight from about 500 to 50,000 and preferably from about 1,000 to 15,000.

Examples of polymerization initiators which can be used to prepare polymers in both structural classes include initiators of the free radical type, such as ammonium and potassium persulfate, which can be used alone (thermal initiator) or as the oxidizing component of a redox system, which also includes a reducing component such as potassium metabisulfite, sodium thiosulfate, or sodium formaldehyde sulfoxylate. Examples of peroxide free-radical initiators include the alkali metal perborates, hydrogen peroxide, organic hydroperoxides and peresters. In a redox system, the reducing component is frequently referred to as an accelerator. The initiator and accelerator, commonly referred to as catalyst, catalyst system or redox system, can be used in a proportion of from 0.001% to 5% each, based on the weight of the monomers to be copolymerized. Examples of redox catalyst systems include t-butylhydroperoxide/sodium formaldehyde sulfoxylate/Fe(II) and ammonium persulfate/sodium bisulfite/sodium hydrosulfite/Fe(II). Activators such as the chloride or sulfate salts of cobalt, iron, nickel or copper can be used in small amounts. Examples of thermal initiators include t-butyl peroxypivalate, dilauroyl peroxide, dibenzoyl peroxide, 2,2-azobis(isobutyronitrile), dicumyl peroxide, t-butyl perbenzoate, and di-t-butyl peroxide. The polymerization temperature can be from ambient temperature up to the reflux temperature of the polymerization reaction mixture. Preferably, the polymerization temperature is optimized for the catalyst system employed, as is conventional. The polymerization can be carried out at atmospheric pressure, preferably as the reaction vessel is purged or swept with an inert gas, such as nitrogen, to reduce oxygen inhibition of the reaction. Alternatively, either subatmospheric or superatmospheric pressure reaction conditions can be employed.

The average molecular weight of the polymers can be controlled by employing a water miscible liquid such as organic compound which functions as a chain transfer agent, such as a lower alkyl alcohol, isopropanol being especially preferred. In this especially preferred process for preparing the polymers of the present invention, the dielectric constant of the nonaqueous solvent must be sufficiently great so that the solvent can dissolve ethylenically unsaturated $C_3$—$C_6$ monocarboxylic acid monomers or their water soluble salts, A mixed solvent including water and water miscible organic solvent can also be used. Mixed solvents including both water and isopropanol are preferred. However, other organic compounds which are miscible with water at the polymerization temperature, such as ethanol, Carbitols, alkyl Cellosolves ® (trademark of DuPont de Nemours), and glymes can also be used.

The polymers of the first class preferably include, about 20 to 95% by weight of the polymer of residues of ethylenically unsaturated monocarboxylic acid having 3 to 5 carbon atoms, preferably 3 to 5 carbon atoms, or the water soluble salt of such acid. The acid and/or acid salt bearing residues preferably result from the polymerization of ethylenically unsaturated $C_3$–$C_6$ monocarboxylic acids and/or their water soluble salts. Alternatively, carboxylic acid bearing residues are derived from the hydrolysis of an ester precursor, the residue bearing the ester precursor having been formed by the polymerization of a polymerizable ethylenically unsaturated carboxylic acid ester, the acyl portion thereof including 3 to 6 carbon atoms.

The polymerization reaction mixture can include either a single species of ethylenically unsaturated $C_3$–$C_6$ monocarboxylic acid, a salt of such an acid which is soluble in the polymerization solvent, or a mixture of the acid and the salt of the acid. Alternatively, the polymerization mixture can contain a mixture of two or more ethylenically unsaturated $C_3$–$C_6$ monocarboxylic acids and/or soluble salts of such acids.

When a solution polymerization process is used, it is preferable that the salt also be soluble in the polymerization solvent if the solvent is not water. When water or a high dielectric constant solvent is employed, it is preferable to gradually add monomer to the polymerization reaction mixture. Additional components such as initiator can be included with the added monomer. The composition of this monomer feed can vary with time. For example, while the feed may initially contain a single ethylenically unsaturated $C_3$—$C_6$ monocarboxylic acid monomer or a soluble salt of such a monomer, subsequently the monomer feed can include a second such ethylenically unsaturated $C_3$–$C_6$ monocarboxylic acid monomer or mixture of such monomers Examples of ethylenically unsaturated $C_3$–$C_6$ monocarboxylic acid monomers which can be used include acrylic acid, methacrylic acid, beta-acryloxypropionic acid, vinylacetic acid, vinylpropionic acid and crotonic acid. Acrylic and methacrylic acids are preferred and acrylic acid is especially preferred. Examples of polymerizable ethylenically unsaturated $C_3$–$C_6$ monocarboxylic soluble salts include sodium acrylate potassium methacrylate, sodium acryloxypropionate, ammonium propionate, and tetramethylammonium acrylate. Sodium and potassium salts of acrylic and methacrylic acid are preferred; and sodium acrylate is especially preferred.

In one group of processes for preparing the polymers of the first class of the present invention, the carboxylic acid and/or acid salt bearing monomer is copolymerized with "surfactant monomer" including the surfactant radical $R^c$. The surfactant monomer can be prepared by esterifying a copolymerizable ethylenically unsaturated carboxylic acid compound. Examples of ethylenically unsaturated carboxylic acid compounds which can be so esterified include ethylenically unsaturated monocarboxylic acids, such as acrylic acid and methacrylic acid, and ethylenically unsaturated dicarboxylic acids such as itaconic acid, fumaric acid and maleic acid. When an ethylenically unsaturated polycarboxylic acid is esterified, it can be either completely or only partially esterified. Alternatively, an ethylenically unsaturated carboxylic acid ester can be transesterified to prepare the surfactant monomer. Examples of ethylenically unsaturated carboxylic esters which can be transesterified include ethyl acrylate and methyl methacrylate. Conventional esterification and transesterification processes and conditions can be used. Acidic esterification catalysts can be used, including p-toluene sulfonic acid, methane sulfonic acid, acidic organometallic salts and acidic ion exchange resins Polymers of the first class can be prepared by copolymerizing an ethylenically unsaturated $C_3$—$C_6$ carboxylic acid monomer with a surfactant monomer such as disclosed in German unexamined application DE-OS 27 58 122.

More generally, the surfactant monomer can be any ethylenically unsaturated compound, including the surfactant radical, and which is copolymerizable with the ethylenically unsaturated $C_3$—$C_6$ monocarboxylic acid and/or water soluble acid salt. For example, the surfactant monomer can include a surfactant radical which is covalently linked through a carbamate functional group to a portion of the compound which includes a copolymerizable carbon-carbon double bond. After polymerization, this carbon-carbon double bond becomes a carbon-carbon single bond. Examples of this type of surfactant monomer include the carbamate formed by the reaction of ethylenically unsaturated isocyanates and alcohols which include the surfactant radical. More specifically, examples of such monomers include the carbamate formed by a surfactant alcohol and alpha,alpha-dimethyl-meta-isopropenyl benzyl isocyanate, and the carbamate formed the by the reaction between a surfactant alcohol and isocyantoethyl methacrylate.

Other examples of surfactant monomers include allyl, methallyl and vinyl-functional surfactant monomers. (Meth)allyl surfactant monomers can be represented by the formula $CH_2{=}CR^1CH_2R^c$ where $R^1$=H, $CH_3$; and vinyl surfactant monomers by the formula $CH_2{=}CH{-}R^c$. Examples of (meth)allyl functional surfactant monomers include allyl ethers such as $CH_2{=}CH{-}CH_2O{-}(CH_2CH_2O)_{20}{-}C_8H_{17}$ and $CH_2{=}CH{-}CH_2O{-}(CH_2CH_2O)_{25}{-}C_6H_4{-}CH_{19}$. Examples of vinyl-functional surfactant monomers include $CH_2{=}CH{-}O{-}(CH_2CH_2O)_{18}C_3H_7$ and $CH_2{=}CH{-}S{-}(CH_2CH_2O)_{19}{-}C_6H_4{-}C_8H_{17}$. The (meth)allyl functional surfactant monomers can be prepared by the methods disclosed in British Pat. No. 1,273,552

A surfactant monomer can generally be prepared by reaction between a first compound including polymerizable ethylenic unsaturation and a second, reactive functional group, and a second compound which includes the surfactant radical as well as a functional group reactive with the second functional group on the first compound. The preparation of suitable surfactant monomers is disclosed, for example, in British patent specification No. 1,167,534 and U.S. Pat. Nos. 4,138,381, and 4,268,641. The surfactant radical containing compound is preferably an alcohol, with the reactive functional group being the hydroxyl group. In general, the surfactant radical containing compound is itself a surface active or surfactant compound, as it must contain both a hydrophobic hydrocarbyl group and a hydrophilic poly(alkylene-oxy) group. However, it should be noted that because the hydrocarbyl group can be as small as $C_1$ (i.e., methyl) and the poly(alkyleneoxy) group may contain as many as 100 ethylene oxide units, the surfactant radical containing compound need not itself be functional as a surfactant.

Preferably, the surfactant radical containing compound is prepared by a conventional process in which a hydrocarbyl alcohol such as ($C_1$—$C_{18}$)alkanol or ($C_1$-$C_{12}$)alkylphenol is treated with an alkylene oxide, preferably ethylene oxide, to form a hydrocarboxy poly(alkyleneoxy) alkanol, preferably a ($C_1$-$C_{18}$) alkaryloxy poly(alkyleneoxy) ethanol. For example, a nonylphenoxy poly (ethyleneoxy) ethanol such as Triton® (trademark of Rohm and Haas Company) N-57, N-101, N-111, or N-401 can be used. Similarly, octylphenoxy poly(ethyleneoxy) ethanols such as Triton X-15, X-35, X-45, X-100, X-102, X-155, X-305, and X-405 can be used. In addition, polyethoxylated straight chain alcohols can also be used. For example, polyethyleneoxylated lauryl alcohol, polyethyleneoxylated oleyl alcohol, and polyethyleneoxylated stearyl alcohol, such as those sold under the Macol trademark can be employed.

As an alternative to copolymerizing one or more ethylenically unsaturated $C_3$-$C_6$ monocarboxylic acid and/or soluble salt monomer with one or more surfactant monomer, the surfactant radical containing compound can be used to partially esterify or transesterify a polymer formed by polymerizing the one or more ethylenically unsaturated $C_3$-$C_6$ monocarboxylic acid monomers and/or the water soluble salt of such monomer. The esterification of such polymeric polycarboxylic acids is well known, and conventional processes may be used to effect the esterification. For example, the polymers of the first class can be prepared by transesterfying homopolymers of monoethylenically unsaturated $C_3$-$C_6$ carboxylic acids or copolymers thereof with surfactant radical containing alcohol such as disclosed in European patent application No. 84108067.4, published Mar. 25, 1985. The esterification of polyacrylic acids is well known in the polymer arts.

In this case, a surfactant monomer need not be prepared and isolated. Thus, the use of this process may be preferred over a process in which the surfactant monomer is prepared and reacted with the acid monomer. However, the factors which can influence the selection of a method include the relevant difficulty of preparing and purifying or isolating a particular surfactant monomer, the reactivity ratio of the surfactant monomer with the acid monomer or monomers to be used in the polymerization, and the efficiency of the esterification process.

If desired, small aoounts of additives such as surfactants, miscible cosolvents, and the like, can be employed in the polymerization medium. Small amounts of surfactants can be added to the monomer solution to improve monomer compatibiity, especially when both hydrophilic and hydrophobic monomer are used to reduce coagulation and to improve the application properties of the polymer composition. When an aqueous or hydrophilic polymerization medium is employed, anionic surfactants such as alkyl sulfates, alkylaryl sulfonates, fatty acid soaps, monoglyceride sulfates, sulfo ether esters, and sulfoether N-alkyl amides of fatty acids, can be used. Similarly, nonionic surfactants can often be employed, such as poly(alkyleneoxy) alkanols of alkyl phenols and alkyl creosols, and poly(alkyleneoxy) derivatives of aliphatic alcohols and other hydroxy compounds carboxyl compounds, and carboxylic acid amides and sulfonamides. A preferred surfactant is Triton® (trademark of Rohm and Haas Co.) X-100 octylphenoxypoly(ethyleneoxy) ethanol. The proportion of surfactant employed depends upon the type of surfactant used and the ultimate use intended for the polymeric composition, and can vary from 0 to about 10% by weight of monomer.

Among the monomers which can be optionally included in the polymerization mixture to prepare the polymers of the present invention are the "carboxylate-free" monomers. This monomer class is broadly defined to include all copolymerizable ethylenically unsaturated monomers excluding the carboxylic acid monomers and the surfactant monomers. Thus the carboxylate-free monomers include ethylenically unsaturated polymerizable monomers which include carboxylic ester functional groups such as the lower alkyl acrylates; it being understood that in each case the carboxylate-free monomer does not fall within the surfactant monomer class.

Examples of carboxylate-free ethylenically unsaturated monomers include (meth)acrylamide and substituted (meth)acrylamides such as N,N-diethyl acrylamide; N-ethyl acrylamide and N,N-dipropyl methacrylamide; alkyl (meth)acrylates such as methyl methacrylate, ethyl acrylate, methyl acrylate, n-butyl acrylate, cyclohexyl acrylate, isopropyl acrylate, isobutyl acrylate, n-amyl acrylate, n-propyl acrylate, ethyl methacrylate, n-propyl methacrylate, n-butyl methacrylate, isopropyl methacrylate, n-octyl methacrylate, dodecyl methacrylate, neopentyl acrylate, n-tetradecyl acrylate, n-tetradecyl methacrylate, isobutyl methacrylate, n-amyl methacrylate n-hexyl methacrylate, isoamyl methacrylate, cyclopentyl methacrylate, n-decyl methacrylate, 2-ethylhexyl acrylate, lauryl acrylate, and the like; hydroxy-substituted (meth)acrylates such as 2-hydroxyethyl acrylate and 3-hydroxypropyl acrylate; amino-substituted alkyl (meth)acrylate including mono- and dialkylaminoalkyl (meth)acrylates such as dimethylaminoethyl methacrylate, methyl-aminoethyl methacrylate and 3-aminopropyl acrylate; other acrylate and methacrylate esters such as methyl 2-cyanoacrylate, 2-bromoethyl methacrylate, isobornyl methacrylate, phenyl methacrylate, 1-naphthyl methacrylate, dicyclopentenyloxyethyl methacrylate, dicyclopentenyloxypropyl methacrylate, benzyl methacrylate, 2-phenylethyl methacrylate, 3-methoxybutyl acrylate, 2-methoxybutyl methacrylate, and 2-n-butoxyethyl methacrylate; vinyl esters such as vinyl versatate, vinyl propionate, vinyl butyrate, vinyl isobutyrate, vinyl caproate, vinyl 2-ethylhexonate and vinyl decanoate; esters of other ethylenically unsaturated carboxylic acids such as monalkyl, dialkyl and trialkyl esters of di- and tri- carboxylic acids such as itaconic acid, and the like, such as di(2-ethylhexyl) maleate, dimethyl fumarate, dimethyl itaconate, diethyl citraconate, trimethyl aconitate, diethyl mesaconate, monomethyl itaconate, mono n-butyl itaconate, di(2-ethylhexyl) itaconate and di-(2-chloroethyl) itaconate; sulfonic acids such as sulfoethyl methacrylate, and sulfopropyl acrylate; and phosporic acids such as 2-phosphoethyl (meth)acrylate, and vinyl phosphoric acid. Additional polymerizable unsaturated monomers which can be used as carboxylate-free monomers include aromatic monomers such as styrene, alpha-methyl styrene, and vinyl toluene, acrylonitriles such as acrylonitrile itself, methacrylonitrile, alpha-chloroacrylonitrile, and ethyl acrylonitrile; vinyl ethers such as methyl vinyl ether, isopropyl vinyl ether, n-butyl vinyl ether, isobutyl vinyl ether, tert-butyl vinyl ether, 2-ethylhexyl vinyl ether, 4-hydroxybutyl vinyl ether, 2-dimethylaminoethylvinyl ether, 1,4-butaneglycol divinyl ether, diethyleneglycol divinyl ether; allyl compounds such as allyl chloride, methallyl chloride, allyl methyl ether and allyl ethyl ether; other monomers such as vinylidene chloride, vinyl chloride, vinyl fluoride, vinylidene fluoride, sodium vinyl sulfonate, butyl vinyl sulfonate, phenyl vinyl sulfone, methyl vinyl sulfone, N-vinyl pyrrolidinone, N-vinyl oxazolidinone, triallyl cyanurate, triallyl isocynanurate, acrolein, acrylamide, methacrylamide, allyl triethoxysilane, allyl tris(-trimethylsiloxy) silane, 3-acryloxypropyltrimethoxy silane, and the like Other carboxylate-free monomers can also be used, including surfactant radical carboxylate-free monomers bearing $R^c$ groups including polymerizable allyl- and vinyl-functional surfactant carboxylate-free monomers. Ethyl acrylate is a preferred carboxylate-free monomer. Up to about 30% by weight of the polymer of the first class can be comprised of the polymerized residues of carboxylate-free monomer which do not include $R^c$ groups. Thus, carboxylate-free monomer is reflected by the D group in formula (I) and, in the case of $R^c$- functional carboxylate-free monomer, in the C groups as well. One or more carboxylate-free monomers can be copolymerized with the ethylenically unsaturated $C_3$–$C_6$ carboxylic acid monomer.

An especially preferred process for preparing polymers of the first class is disclosed in copending commonly assigned U.S. patent application Ser. No. 142,102. In this "in process functionalization" process, a surfactant radical containing compound, specifically a surfactant alcohol having the structure $R^1Z(X^1)_a$—$(X^2)_bH$ is used as the solvent or medium for the polymerization of the ethylenically unsaturated $C_3$—$C_6$ monocarboxylic acid monomer and optional carboxylate-free monomers. After polymerization, the mixture of the polymer and the surfactant alcohol is heated to complete the esterification. The water of condensation is removed from the reaction mixture by vacuum or azeotropic distillation. If azeotropic distillation is used, a 10 solvent, such as toluene, can be added either before or after the polymerization step. If desired, a chain transfer agent, preferably a mercaptan, is added during the polymerization to control polymer molecular weight.

The polymers of the second structural class of the present invention are prepared by a novel process. In the first step of the process, a compound, preferably an alcohol, including the surfactant radical $R^c$ is used to esterify or transesterify a mercapto-acid or a mercapto-ester, respectively, by conventional methods. Preferably, the mercapto-acids employed have the formula $HO_2C(CH_2)_c$—SH where c is 1, 2 or 3. Examples of mercapto-acids which can be used include 3-mercaptopropionic acid, 4-mercapto-n-butyric acid, and mercaptoacetic acid. Preferably, an alkyl ester of one of the preferred mercapto acids is used when the "surfactant" mercaptan is prepared by transesterification. For example, methyl 3-mercaptopropionate can be used.

In the second step of the process for preparing the polymers of the second class, the surfactant mercaptan is utilized as a chain transfer agent in an otherwise conventional polymerization of ethylenically unsaturated $C_3$—$C_6$ monocarboxylic acid monomer and optional carboxylate-free monomer. For example, the surfactant mercaptan can be used as a chain transfer agent in a solution polymerization in water, in a water miscible solvent such as isopropanol, a mixture of water and a water miscible solvent, and the like.

The detergent compositions of the present invention include at least one surfactant selected from the anionic and nonionic surfactants. When liquid detergent compositions are prepared, it is preferred that the water soluble polymer and its concentration in the detergent composition be selected to be compatible with the other components of the composition. That is, addition of effective amounts of the water soluble polymer should not induce phase separation, and the polymer should be soluble or dispersible in the composition at the concentration used. Preferably, liquid detergent compositions of the present invention contain from about 0.5% by weight to 5% of the polymer.

Examples of classes of anionic surfactants which can be used in formulating detergent compositions of this invention include both soaps and synthetic anionic surfactants. Examples of soaps include the higher fatty acid soaps such as the sodium and potassium salts of $C_{10}$–$C_{18}$ fatty acids, derived from saponification of natural fats, such as tallow, palm oil, and coconut oil; or from petroleum; or prepared synthetically. Depending on the source, these fatty acid salts can have either an even or an odd number of carbon atoms, and be branched or have straight carbon chains.

The anionic surfactants include water soluble salts of: sulfonated paraffin derived alkylbenzenes, generally referred to in the art as linear alkyl benzene sulfonate surfactants (LAS), sulfonated fatty alcohols ("alcohol sulfates"—AS), sulfate ethers derived from nonionic surfactants ("alcohol ether sulfates"—AES); alpha-olefin sulfonates derived from oligomerized ethylene or alpha-olefins (AOS); paraffin-derived secondary alkane sulfonates (SAS); alkoyl amides prepared by ammonolysis of lower alkyl esters of fatty alcohols with alkanolamines amine oxides derived from oxidation of amines prepared from fatty alcohols or alpha-olefins; sulfosuccinates derived from fatty alcohols and maleic anhydride; and the like. Heavy duty liquid detergent products for laundry use frequently contain LAS and/or nonionic surfactants. Light duty detergent products for diswashing use frequently contain LAS and AES or AES and amine oxide surfactants.

Examples of classes of nonionic surfactants which can be used in formulating detergent composition of the present invention include condensation products of alkylene oxides and fatty alcohols, such as those derived from coconut oil, tallow, and tall oil; condensation products of alkylene oxide and alcohols derived from ethylene oligomerized by Ziegler processes; condensation products of secondary alcohols derived from paraffin; condensation products of alkylphenols and alkylene oxides; and the like.

In addition to one or more surfactants and the water soluble polymer, the detergent compositions can also contain, for example, additional builders, such as sodium tripolyphosphate (solid compositions) or tetrapotassium pyrophosphate (liquid compositions), sodium carbonate, sodium citrate, and zeolites; protective agents such as sodium silicate; additional antiredeposition agents such as carboxymethylcellulose and polyvinylpyrrolidone; dyes; perfumes; foam stabilizers such as amine oxides; enzymes, such as proteases, amylases, celluloses, and lipases; fabric softeners; processing aids such as sodium sulfate; bleaches including chlorine and oxygen bleaches; optical brighteners; antistatic agents; hydrotopes such as xylene and toluene sulfonate and ethanol; opacifiers; and skin conditioners (light duty liquid detergents).

Advantageously, the polymers of the present invention can be used to replace a portion of the phosphate builder in certain detergent compositions, lessening the adverse effect of waste water containing the detergent in the environment.

The water soluble polymers of the present invention are of particular value as additives for commercial heavy and light duty liquid detergent compositions for consumer use. These products are highly formulated materials which include a relatively large number of components. Despite the large number of possible adverse interactions between one or more of the existing components of these commercial products and the water soluble polymer, the polymer can be added directly to the detergent composition without reformulation. This compatibility is very advantageous and permits detergent manufacturers to rapidly realize the benefits of the present invention.

In addition to serving as builders or detergent assistants in liquid detergent compositions for consumer laundry and dishwashing, the polymers of the present invention can also be used in other cleaning products, as well as dispersants in a variety of applications. For example, the polymers can be used as ingredients in cleaning compositions formulated for use as hard surface cleaners for consumer and institutional use, in solid detergent and soap compositions, such as bars, cakes, tablets, powders and the like, in institutional and industrial cleaning products intended for the food and food service industries and commercial and institutional laundries, in metal degreasing compositions, in carpet cleaners, and in automotive cleaning products.

Formulations for a variety of detergent products can be found, for example, in *Detergency, Part I* (W. G. Cutler and R. C. Davis ed.s, Marcel Dekker, New York, 1972) at 13–27.

As dispersants the polymers find use as pigment dispersants for coating, paints, inks and the like, and as particle dispersants for well drilling muds, coal slurries, and the like.

The polymers of this invention are also useful in the water conditioning arts, and especially in products and applications employing sequestering agents for hard water ions.

The following examples will aid those skilled in the art in understanding the present invention; however, the present invention is in no way limited thereby. In the following examples, percentage composition is by weight. The following abbreviations are used in the examples which follow:

| | |
|---|---|
| IPA | isopropanol |
| MAc | maleic acid |
| MAn | maleic anhydride |
| AA | acrylic acid |
| MAA | methacrylic acid |
| Lup 11 | Lupersol ® (trademark of Pennwalt Corp.) 11, t-butyl peroxypivalate (75% w/w in mineral spirits) |
| EO | ethylene oxide |
| TGA | thioglycolic acid (95%) |
| DDM | n-dodecylmercaptan |
| NaPS | sodium persulfate |
| EA | ethyl acrylate |
| 3-MPA | 3-mercaptopropionic acid |

EXAMPLE 1

Preparation of Copolymers in a Hydrophilic Solvent

In a reactor provided with a stirrer 750 parts by weight deionized water and 250 parts isopropanol were heated to 82° C. A monomer/initiator mixture was made containing 350 parts by weight acrylic acid, 150 parts by weight of an ester of methacrylic acid and an ($C_{16}$–$C_{18}$)alkoxypoly(ethyleneoxy)ethanol having about twenty ethoxy units, and 8 parts by weight methacrylic acid. Five minutes before the monomer/initiator feed began, 2 parts by weight Lupersol 11 were added to the 82° C. isopropanol mixture. The monomer/initiator mixture was then metered in over 2 hours, with the reactor contents kept at 82° C. Thereafter, the reactor contents were heated at 82° C. for a further 30 minutes, then cooled, giving a copolymer dissolved in a water-/isopropanol mixed solvent.

EXAMPLES 2–27 AND COMPARATIVE EXAMPLES 1–2

The process of Example 1 was repeated using the weight proportions of components given in Table I to produce the water soluble copolymers of Examples 2–27 and Comparative Examples 1 and 2. In preparing the copolymers of the comparative examples, maleic acid was included in the initial change in the amount shown in the table.

TABLE I

| | Initial Charge | | | | Monomer/Initiator Feed | | | | | |
|---|---|---|---|---|---|---|---|---|---|---|
| | | | | | | | | | Ester of MAA and EO Alcohol | |
| | IPA Parts | $H_2O$ Parts | MA Parts | Lup 11 Parts | AA Parts | MAA Parts | Lup 11 Parts | MAA Parts | Parts | Type of EO Alcohol[1] |
| Example | | | | | | | | | | |
| 2 | 1000 | — | — | 2 | 350 | — | — | 8 | 150 | $C_{16-18}$ + 20 EO |
| 3 | 1000 | — | — | 2 | 450 | — | — | 8 | 50 | $C_1$ + 42 EO |
| 4 | 250 | 750 | — | 2 | 450 | — | — | 8 | 50 | $C_1$ + 42 EO |
| 5 | 1000 | — | — | 2 | 350 | — | — | 8 | 150 | $C_1$ + 42 EO |
| 6 | 250 | 750 | — | 2 | 350 | — | — | 8 | 150 | $C_1$ + 42 EO |
| 7 | 1000 | — | — | 2 | 450 | — | — | 8 | 50 | $C_{16-18}$ + 40 EO |
| 8 | 250 | 750 | — | 2 | 450 | — | — | 8 | 50 | $C_{16-18}$ + 40 EO |
| 9 | 1000 | — | — | 2 | 350 | — | — | 8 | 150 | $C_{16-18}$ + 40 EO |
| 10 | 250 | 750 | — | 2 | 350 | — | — | 8 | 150 | $C_{16-18}$ + 40 EO |
| 11 | 1000 | — | — | 2 | 450 | — | — | 8 | 50 | $C_{12}$ + 4 EO |
| 12 | 250 | 750 | — | 2 | 450 | — | — | 8 | 50 | $C_{12}$ + 4 EO |
| 13 | 1000 | — | — | 2 | 350 | — | — | 8 | 150 | $C_{12}$ + 4 EO |
| 14 | 250 | 750 | — | 2 | 350 | — | — | 8 | 150 | $C_{12}$ + 4 EO |
| 15 | 1000 | — | — | 2 | 450 | — | — | 8 | 50 | $C_8$ + 5 EO |
| 16 | 250 | 750 | — | 2 | 450 | — | — | 8 | 50 | $C_8$ + 5 EO |
| 17 | 1000 | — | — | 2 | 350 | — | — | 8 | 150 | $C_8$ + 5 EO |
| 18 | 250 | 750 | — | 2 | 350 | — | — | 8 | 150 | $C_8$ + 5 EO |
| 19 | 1000 | — | — | 2 | 350 | — | — | 8 | 150 | $C_1$ + 42 EO |
| 20 | 1000 | — | — | 2 | 350 | — | — | 8 | 150 | $C_{16-18}$ + 20 EO |
| 21 | 1000 | — | — | 2 | 400 | — | — | 8 | 100 | $C_{16-18}$ + 20 EO |
| 22 | 1000 | — | — | 2 | 300 | — | — | 8 | 200 | $C_{16-18}$ + 20 EO |
| 23 | 1000 | — | — | 2 | 350 | — | — | 8 | 150 | $C_{16-18}$ + 20 EO |
| 24 | 1025 | — | — | 6 | 250 | 100 | — | 24 | 150 | $C_{16-18}$ + 20 EO |
| 25 | 2073 | — | — | 5.33 | 250 | 100 | — | 21.33 | 150 | $C_{16-18}$ + 20 EO |
| 26 | 709 | 304 | — | 4 | 250 | 100 | — | 16 | 150 | $C_{16-18}$ + 20 EO |
| 27 | 2019 | 1025 | — | 6 | 250 | 100 | — | 24 | 150 | $C_{16-18}$ + 20 EO |
| Comparative Example | | | | | | | | | | |
| 1 | 740 | — | 16.7[2] | 2 | 300 | — | 33.3[2] | 8 | 150 | $C_{16-18}$ + 20 EO |
| 2 | 740 | — | 33.3 | 2 | 250 | — | 66.7 | 8 | 150 | $C_{16-18}$ + 20 EO |

[1]Indicates number of carbon atoms in alkyl group and degree of ethylene oxide polymerization in the alkloxypoly(ethyleneoxy)-ethanols.
[2]Fed over first 1.33 hours as a solution in 260 parts of isopropanol.

EXAMPLE 28

Preparation of Copolymers in Water

In a reactor provided with a stirrer, 666.5 parts by weight deionized water and 31.2 parts sodium dodecylbenzene sulfonate were heated to 92° C. A mixture of 40 parts deionized water and 12.9 parts thioglycolic acid was metered in over 2½ hours, with the reactor contents kept at 92° C. A mixture of 140 parts acrylic acid, 60 parts of an ester of methacrylic acid and ($C_{16-18}$) alkyloxy(ethyleneoxy)19 ethanol, and 78 parts Lupersol 11 were metered in over 3 hours, with the reactor contents keep at 92° C. Thereafter, the mixture was heated at 92° C. for a further 30 minutes. Then a mixture of 356 parts deionized water and 18.6 parts 50% sodium hydroxide was added while keeping the reactor contents at 92° C. Thereafter, the reactor contents were cooled to 83° C. and 18.9 parts 30% hydrogen peroxide were added. The reactor contents were then cooled to room temperature.

EXAMPLES 29–31

The process of Example 28 was employed to prepare the water soluble polymers of Examples 29–31 using the components given in Table II. In the case of Example 29, an initiator mixture consisting of 40 parts water and 8 parts sodium persulfate was metered into the reactor flask simultaneously with the mercaptan mixture.

TABLE II

| | Initial Charge | Mercaptan Mixture | | | Initiator Mixture | | Monomer Mixture | | | | |
|---|---|---|---|---|---|---|---|---|---|---|---|
| Example | $H_2O$ Parts | $H_2O$ Parts | TGA Parts | DDM Parts | $H_2O$ Parts | NaPS Parts | AA Parts | Ester(II)[1] Parts | MAA Parts | EA Parts | Lup 11 Parts |
| 29 | 652.3 | — | — | 26.9 | 40 | 8 | 140 | 60 | — | — | — |
| 30 | 666.5 | 40 | 12.9 | — | — | — | 100 | 60 | 40 | — | 7.8 |
| 31 | 666.5 | 40 | 12.9 | — | — | — | 120 | 60 | — | 20 | 7.8 |

[1]Ester of methacrylic acid and ($C_{16-18}$) alkoxy(ethyleneoxy)$_{19}$ ethanol.

EXAMPLE 32

A reactor provided with a stirrer and a reflux trap 72 parts by weight toluene and 233 parts by weight Macol (trademark of Mazer Chemicals) CSA 20 ($C_{16-18}$)alkoxy(ethyleneoxy)$_{19}$ ethanol are heated at reflux until all the water was removed. Thereafter, a mixture of 100 parts acrylic acid and 2 parts by weight di-t-butyl peroxide initiator, and a mixture of 19 parts toluene and 10.5 parts 3-mercaptopropionic acid were metered in over 2 hours, with the reactor contents kept at reflux. Toluene was removed as needed to keep the reflux temperature at about 140° C. After the polymerization was complete, the reaction mixture was kept at reflux until esterification was complete. The extent of esterification was monitored by the amount of water removed. Thereafter, the reaction mixture was heated under vacuum until all the toluene has been removed. The resulting copolymer was recovered from the reactor mixture at 100% solids.

EXAMPLE 33

The process of Example 32 was repeated, except that an initial change of 22 parts of toluene was present in the reactor, tert-butyl peroctoate was used as the initiator, and 20 parts of 3-mercaptopropionic acid was used as the chain transfer agent (no toluene).

EXAMPLE 34

Preparation of Copolymer Including Acrylic Acid/Urethane Monomer

In a reactor provided with a stirrer, 600 parts by weight isopropanol was heated to 82° C. A monomer-/initiator mixture was made containing 210 parts acrylic acid, 90 parts of a urethane of a,a,-dimethyl meta-isopropenyl ethanol benzyl isocyanate and a ($C_{16-18}$)alkoxy(ethyleneoxy)19ethanol, and 4.8 parts Lupersol 11. Five minutes before the monomer/initiator feed began, 1.2 parts Lupersol 11 were added to the 82° C. isopropanol. The monomer/initiator mixture was then metered in over 2 hours, with the reactor contents kept at 82° C. Thereafter, the reactor contents were heated at 82° C. for a further 30 minutes, then cooled.

EXAMPLE 35

Preparation of Surfactant Radical-Terminated Copolymer

In a reactor provided with a stirrer, 220 parts deionized water and 240 parts t-butanol were heated to reflux. A mixture of 252.2 parts acrylic acid and 98.2 parts of a thiol-terminated ester of 3-mercaptopropionic acid and a ($C_{16-18}$)alkoxy (ethyleneoxy)$_{19}$ ethanol, and a mixture of 20 parts deionized water, 50 parts t-butanol, and 5.05 parts Lupersol 11 initiator were separately metered in over 3 hours, with the reactor contents kept at reflux or 85° C., whichever was lower. Thereafter, the reactor contents were heated for a further 30 minutes at reflux or 85° C., whichever was lower, then cooled.

COMPARATIVE EXAMPLE 3

Preparation of Maleic Acid Containing Copolymer

A maleic acid containing copolymer was prepared as disclosed in U.S. Pat. No. 4,559,159 as a comparative example. In a reactor provided with a stirrer, 176.3 parts maleic anhydride and 206.5 parts deionized water were heated to 75° C., 259 parts 50% sodium hydroxide were added, then the reactor contents were heated to 100° C. A mixture of 299 parts dionized water, 208.7 parts acrylic acid, and 46.4 parts of an ester of methacrylic acid and a ($C_{16-18}$)alkoxy(ethyleneoxy)19 ethanol was metered in over 5 hours, with the reactor contents kept at 100° C. A mixture of 185 parts deionized water, 4.7 parts sodium persulfate, and 15.5 parts 30% hydrogen peroxide was metered in over 6 hours, with the reactor contents kept at 100° C. Thereafter, the reactor contents were heated at 100° C. for a further 2 hours. Then the mixture was cooled and further neutralized with 308.7 parts triethanolamine. The resulting water soluble polymer was found to have a weight average molecular weight of 22,000 by gel permeation chromotography.

COMPARATIVE EXAMPLES 4 and 5

Preparation of Copolymer of Acrylic Acid and Half-Esters of Polyethylene Glycol and Methacrylic Acid In a reactor provided with a stirrer 200 parts isopropanol were heated to 82° C. A monomer/initiator mixture was made containing 70 parts acrylic acid, 30 parts of a half-ester (prepared by the method described in U.S. Pat. No. 3,719,647) of methacrylic acid and polyethylene glycol (average molecular weight 3400–Comparative Example 4, average molecular weight 1000–Comparative Example 5), and 1.6 parts Lupersol 11 initiator. Five minutes before the monomer/initiator feed began, 0.4 parts Lupersol 11 initiator were added to the 82° C. isopropanol. The monomer/initiator mixture was then metered in over 2 hours, with the reactor contents kept at 82° C. Thereafter, the reactor contents were heated at 82°C. for a further 30 minutes, then cooled.

EXAMPLE A—LIMESOAP DISPERSANCY

Using the procedure given in JOACS 21 (1950) 88, the limesoap dispersancy of water soluble copolymers of the present invention was measured and compared with that of acrylic acid homopolymers (Comparative Examples 6–8) and copolymers of acrylic acid and half-esters of polyethylene glycol and methacrylic acid. (U.S. Pat. No. 3,719,647 - Comparative Examples 4 and 5). The results given in Table III indicate that the copolymers of the present invention are superior to both acrylic acid homopolymers and the copolymers of U.S. Pat. No. 3,719,647 in limesoap dispersancy, an important requirement for detergent compositions used in hard water laundering.

TABLE III

| Example or Comparative Ex. | Polymer Composition | Polymer[3] Molecular Weight | Lime Soap Dispersancy |
|---|---|---|---|
| Comp Ex. 4 | AA/(PEG 3400) | | 12.5 |
| Comp Ex. 5 | AA/(PEG 1000) | | 11.5 |
| Comp Ex. 6[1] | AA | 4500 | 20 |
| Comp Ex. 7 | AA | 1000 | 40 |
| Comp Ex. 8 | AA | 10000 | 15 |
| Ex. 7 | AA/(40 EO/16–18 C)[2] | 3500 | 4 |
| Ex. 8 | AA/(40 EO/16–18 C) | 10000 | 12.5 |
| Ex. 9 | AA/(40 EO/16–18 C) | 3500 | 2 |
| Ex. 10 | AA/(40 EO/16–18 C) | 10000 | 2.5 |
| Ex. 11 | AA/(4 EO/12 C) | 3500 | 5 |
| Ex. 12 | AA/(4 EO/12 C) | 10000 | 20 |
| Ex. 3 | AA/(42 EO/1 C) | 3500 | 20 |
| Ex. 4 | AA/(42 EO/1 C) | 10000 | 12.5 |
| Ex. 5 | AA/(42 EO/1 C) | 3500 | 15 |
| Ex. 6 | AA/(42 EO/1 C) | 10000 | 17.5 |
| Ex. 13 | AA/(4 EO/12 C) | 3500 | 3.5 |
| Ex. 14 | AA/(4 EO/12 C) | 10000 | 15 |
| Ex. 15 | AA/(5 EO/8 C) | 3500 | 15 |
| Ex. 16 | AA/(5 EO/8 C) | 10000 | 15 |
| Ex. 17 | AA/(5 EO/8 C) | 3500 | 10 |
| Ex. 18 | AA/(5 EO/8 C) | 10000 | 20 |
| Ex. 20 | AA/(20 EO/16–18 C) | 3500 | 2.5 |
| Ex. 27 | AA/MAA/(20 EO/16–18 C) | 3000 | 2 |
| Ex. 28 | AA/(20 EO/16–18 C) | 3500 | 3.2 |

TABLE III-continued

| Example or Comparative Ex. | Polymer Composition | Polymer[3] Molecular Weight | Lime Soap Dispersancy |
|---|---|---|---|
| Ex. 30 | AA/MAA/20 EO/16-18 C) | 3500 | 2.1 |
| Ex. 31 | AA/EA/20 EO/16-18C) | 3500 | 1.5 |
| Ex. 32 | AA/(20 EO/16-18 C) | 3700 | 0.8 |
| Ex. 33 | AA/(20 EO/16-18 C) | 3000 | 0.9 |

[1]Comparative Examples 6-8 are acrylic acid homopolymers prepared by a standard aqueous process employing chain transfer agents to provide low molecular weight polymer.
[2]The notation indicates the number of ethylene oxide units in the poly(ethyleneoxy)-ethanol segment and the number of carbon atoms in the alkyl segment of the ester.
[3]Determined by gel permeation chromatography.

EXAMPLE B—SOIL ANTIDEPOSITION

Using the protocol established in ASTM Method D 4008-81, the soil antideposition properties of water soluble copolymers of the present invention were evaluated in comparison with prior art polymers, including homopolymers of acrylic acid and copolymers including maleic acid. 50g of polymer solution (0.080% w/w), followed by 50g of deionized water rinse of the polymer solution jar, was added to the pots of a TERG-0-Tometer for each test. Soil antideposition was measured using bleached 100% cotton cloth, 50/50 polyester-cotton blend, and 100% cotton oxford broad cloth. The results of these measurements are reported in Tables IV and V. The results clearly show that the copolymers of the present invention help prevent the depositon of soil from dirty water, and they are particularly effective in helping avoid the deposition of soil on cotton-polyester fabric. Further, their soil antideposition characteristics are surprisingly comparable or superior to those of copolymers containing maleic acid.

TABLE IV

| Example or Comparative Ex. | Polymer Composition | Polymer Molecular Weight | % Soil Antideposition (3 cycles) | |
|---|---|---|---|---|
| | | | % Reflectance on Cotton[1](ave) | % Reflectance on PE:Cot[2](ave) |
| Comp. Ex. 6 | AA | 4500 | 80.7 | 67.1 |
| Comp. Ex. 8 | AA | 10000 | 85.9 | 65.4 |
| Ex. 7 | AA/(40 EO/16-18 C) | 3500 | 87.8,87.9 | 92.2,92.6 |
| Ex. 8 | AA/(40 EO/16-18 C) | 10000 | 77.1 | 78.5 |
| Ex. 9 | AA/(40 EO/16-18 C) | 3500 | 96.8 | 97.4 |
| Ex. 10 | AA/(40 EO/16-18 C) | 10000 | 85.7 | 92.4 |
| Ex. 11 | AA/(4 EO/12 C) | 3500 | 88.8 | 96.8 |
| Ex. 12 | AA/(4 EO/12 C) | 10000 | 74.6 | 83.8 |
| Ex. 3 | AA/(42 EO/1 C) | 3500 | 90.4 | 90.2 |
| Ex. 4 | AA/(42 EO/1 C) | 10000 | 92.1 | 91.2 |
| Ex. 5 | AA/(42 EO/1 C) | 3500 | 92.3,92.4 | 90.0,89.7 |
| Ex. 6 | AA/(42 EO/1 C) | 10000 | 93.7 | 94.5 |
| Ex. 13 | AA/(4 EO/12 C) | 3500 | 88.9 | 95.7 |
| Ex. 14 | AA/(4 EO/12 C) | 10000 | 78.8 | 76.2 |
| Ex. 15 | AA/(5 EO/8 C) | 3500 | 90.1 | 94.8 |
| Ex. 16 | AA/(5 EO/8 C) | 10000 | 76.7 | 82.5 |
| Ex. 17 | AA/(5 EO/8 C) | 3500 | 86.9 | 94.3 |
| Ex. 18 | AA/(5 EO/8 C) | 10000 | 76.0 | 80.2 |

[1]% reflectance on bleached 100% cotton cloth, average of 20 determinations (10 cloths, two sides).
[2]% reflectance on 65/35 polyester/cotton cloth. Average of 20 determinations of (10 cloths, two sides).

TABLE V

| Example or Comparative Ex. | Polymer Composition | Polymer Molecular Weight | % Soil Antideposition (3 cycles) | |
|---|---|---|---|---|
| | | | % Reflectance on Cotton[1](ave) | % Reflectance on PE:Cot[2](ave) |
| Ex. 21 | AA/(20 EO/16-18 C) | 3070 | 76.8 | 92.2 |
| Ex. 22 | AA/(20 EO/16-18 C) | 2660 | 87.5 | 96.9 |
| Ex. 27 | AA/(20 EO/16-18 C) | 3130 | 80.7 | 96.3 |
| Ex. 2 | AA/MAn/20 EO/16-18 C) | 21000 | 65.9 | 85.2 |
| Comp. Ex. 1 | AA/MAc/20 EO/16-18 C) | 2820 | 75.6 | 94.3 |
| Comp. Ex. 2 | AA/MAc/20 EO/16-18 C) | 2530 | 79.7 | 95.2 |

[1]% reflectance on bleached 100% cotton oxford broad cloth.
[2]% reflectance on 65/35 cotton/polyester cloth.

EXAMPBLE C—ANTIDEPOSITION WITH LIQUID DETERGENT

The soil antideposition test was repeated using the protocol of ASTM method D 4008-81 except that 50g of a commercial detergent solution (4.0% w/w) and 50g of the polymer solution (0.080% w/w) were added to the Terg-0-Tometer test pots for each test. The results of the tests are reported in Tables VI and VII, and show that the water soluble polymers of the present invention improve the soil antideposition properties of commercially available household liquid laundry detergents. In addition, the improvement is unexpectedly greater than that obtained either by use of a homopolymer of acrylic acid (Comparative Example 6), polyethylene glycol, additional anionic or nonanionic surfactants or alkoxypolyethoxyethanol.

TABLE VI

| Example or Comparative Ex. | Polymer Composition | Polymer Molecular Weight | Detergent | % Soil Antideposition (3 cycles) | |
|---|---|---|---|---|---|
| | | | | % Reflectance on Cotton[1](ave) | % Reflectance on PE:Cot[2](ave) |
| — | none | — | A[4] | 85.3 | 98.9 |
| — | NaCMC[3] | 80000 | A | 85.0 | 99.6 |
| Comp. Ex. 6 | AA | 4500 | A | 85.3 | 99.0 |

TABLE VI-continued

| Example or Comparative Ex. | Polymer Composition | Polymer Molecular Weight | Detergent | % Soil Antideposition (3 cycles) % Reflectance on Cotton[1](ave) | % Reflectance on PE:Cot[2](ave) |
|---|---|---|---|---|---|
| Ex. 20 | AA/(20 EO/16–18 C) | 3500 | A | 87.2 | 98.9 |
| Ex. 35 | AA/(20 EO/16–18 C) | 4250 | A | 87.0 | 99.2 |

[1]Bleaches 100% cotton cloth.
[2]65/35 polyester/cotton blend cloth.
[3]Sodium carboxymethyl cellulose.
[4]Commercial Detergent A is a household liquid detergent containing "cleaning agents (anionic, nonionic and cationic surfactants, enzymes), water softeners (laurate, citrate), dispensing aids (ethyl alcohol, propylene glycol), buffering agents, water, stabilizing agents, soil suspending agent, fabric whiteners, colorant and perfume."

TABLE VII

| Example or Comparative Ex. | Polymer Composition | Polymer Molecular Weight | Detergent | % Soil Antideposition (3 cycles) % Reflectance on Cotton[1](ave) | % Reflectance on PE:Cot[2](ave) |
|---|---|---|---|---|---|
| No polymer | | — | A[7] | 78.0 | 98.6 |
| — | (20 EO/16–18 C)[3] | 1237 | A | 79.6 | 99.5 |
| — | (7 EO/12–15 C)[4] | 522 | A | 78.2 | 98.7 |
| — | PEG[5] | 8000 | A | 79.4 | 99.1 |
| — | $C_{18}H_{29}SO_3^- Na^+$[6] | 348 | A | 77.2 | 98.4 |
| Ex. 20 | AA/(20 EO/16–18 C) | 3500 | A | 84.4,84.7,83.6 | 99.2,99.9,100.7 |
| Ex. 27 | AA/MAA/(20 EO/16–18 C) | 3080 | A | 83.0 | 100.4 |
| Ex. 28 | AA/(20 EO/16–18 C) | 2910 | A | 82.8 | 100.5 |
| Ex. 29 | AA/(20 EO/16–18 C) | 4410 | A | 83.1 | 100.4 |
| Ex. 34 | AA/(20 EO/16–18 C) | 3780 | A | 83.0 | 100.7 |
| Ex. 25 | AA/MAA/(20 EO/16–18 C) | 2420 | A | 80.5 | 98.5 |
| Ex. 26 | AA/MAA/(20 EO/16–18 C) | 5000 | A | 83.5 | 98.5 |
| Ex. 32 | AA/(20 EO/16–18 C) | 3700 | A | 83.9 | 98.7 |
| No polymer | — | — | B[8] | 84.5 | 97.6 |
| Ex. 20 | AA/(20 EO/16–18 C) | 3500 | B | 93.1 | 98.9 |
| Ex. 24 | AA/MAA/(20 EO/16–18 C) | 3060 | B | 93.0 | 98.1 |
| No polymer | — | — | C[9] | 77.7 | 94.2 |
| Ex. 20 | AA/(20 EO/16–18 C) | 3500 | C | 88.4 | 96.2 |
| Ex. 24 | AA/MAA/(20 EO/16–18 C) | 3060 | C | 85.1 | 96.0 |

[1]100% cotton oxford broad cloth.
[2]65/35 polyester/cotton blend cloth.
[3]Macol TM (trademark of Mazer Chemicals) CSA-20 ($C_{16}$–$C_{18}$)alkoxy(ethoxy)$_{19}$ ethanol.
[4]Neodol TM (trademark of Shell Chemical Co.) 25-7 - ($C_{12}$–$C_{15}$)-alkoxy (ethoxy)$_6$ ethanol - nonionic surfactant.
[5]Carbowax ® (trademark of Union Carbide Corp. 8000 - polyethylene glycol.
[6]Sodium lauryl sulfate - anionic surfactant.
[7]See Table VI above.
[8]Commercial Detergent B is a household liquid laundry detergent which "contains a combination fo anionic and nonionic surfactants (wetting agents to loosen soil); sodium citrate (softens water; improves cleaning) stabilizer (prevents product separation) buffering agent (improves cleaning), soap, (suds controller), perfume, brightening agents, and colorant."
[9]Commercial Detergent C is a household liquid laundry detergent which "is an aqueous suspension containing a combination of anionic and nonionic surfactants (wetting agents to loosen soil); sodium citrate (softens water, improves cleaning);stabilizer (prevents product separation); buffering agent (improves cleaning); anti-redeposition agent (suspends soil); perfume, brightening agents, opacifier, and colorants."

EXAMPLE D—COMPATABILITY WITH LIQUID HOME LAUNDRY DETERGENTS

The polymers were added to Commercial Detergent A and Commercial Detergent B, whose compositions have been referenced above. The initial level of polymer was 1%, which was then increased if compatability was found.

The detergent-polymer solutions were stored at room temperature and evaluated for stability (phase separation) with time for approximately 270 days if initially stable.

As shown in Table VIII, the polymers of the present invention were more compatible in the high surfactant containing liquid laundry detergents than the acrylic acid homopolymer.

TABLE VIII

| Commercial Detergent | Polymer | Level | Observation |
|---|---|---|---|
| A | Comp. Ex. 6 | 1.0 | phase separation - 7 hours |
| A | 20 | 1.0 | stable |
| A | 20 | 1.5 | stable |
| A | 20 | 2.0 | phase separation - 24 hours |
| B | Comp. Ex. 6 | 1.0 | phase separation - immediate |

TABLE VIII-continued

| Commercial Detergent | Polymer | Level | Observation |
|---|---|---|---|
| B | 20 | 1.0 | stable |
| B | 20 | 1.5 | stable |

EXAMPLE E—FOAM STABILITY OF HAND DISHWASHING DETERGENTS

The effect of addition of water soluble polymers of the present invention on the foam stability of hand dishwashing detergents was measured employing the procedure of R. 0267 M. Anstett and E. J. Schuck, *J.A.O.C.S.* (Journal of the American Oil Chemists Society) (October 1966). Volume 43, pages 576–580.

The results reported in Table IX indicate that the water soluble polymers of the present invention enhance the cleaning performance of hand dishwashingg detergents as measured by the foam stability. It should be noted that the addition of polymer increases the solids by approximately 13%, but the performance with polymer addition is increased about 50%.

TABLE IX

| Polymer[1] Example | #3 Plate Units | #1 Plate Units | Total Plates |
|---|---|---|---|
| No polymer | 2 | 4 | 10 |
| No polymer | 2 | 3 | 9 |
| 20 | 3 | 6 | 15 |
| 20 | 3 | 5 | 14 |
| 32 | 4 | 3 | 15 |
| 32 | 3 | 5 | 14 |

[1]Polymer was used at a 5% level based on the weight of the detergent, which was a commercial product containing biodegradable surfactants and no phosphorus, and having 39.3% solids.

1. Polymer was used at a 5% level based on the weight of the detergent, which was a commercial product containing biodegradable surfactants and no phosphorus, and having 39.3% solids.

EXAMPLE F—HARD SURFACE CLEANING—MACHINE DISHWASHING

The effect of copolymers of the present invention on the performance of machine dishwashing detergents was studied using a modification of ASTM Test Method D 3556-85, "Deposition on Glassware during Mechanical Dishwashing". The modifications of the test method were to use a higher soil loading, 60 gms instead of the 40 gms specified under the procedure, and to wash the ware using a 'short' dishwashing cycle. This provides a 25 minute wash, a 2 minute rinse and an 8 minute rinse. The test conditions were: 54° C., 200 ppm hardness as $CaCO_{O3}$ (hard water) and 37.5 gms of liquid detergent (Cascade®—trademark of Procter and Gamble). The polymer which was used was like Example 32, with a composition of about 30% acrylic acid and 70% of a cetyl/stearyl alcohol with 40 moles of ethylene oxide, $M_n$ of about 3700. This was used at a 2% level on the detergent.

The results given in Table X after one cycle show the advantage of the polymer of the present invention in the detergent with the glass ratings in spotting. The rating system is similar to the test method: 0—no spots, 1—spots barely perceptible, 2—slight spotting, 3—50% of the glass is covered with spots, and 4—the whole glass is covered with spots.

TABLE X

| Spotting on glass # | Grease Deposition |
|---|---|
| Cascade ® detergent alone | |
| $\frac{1}{2}$ $\frac{2}{2}$ $\frac{3}{2}$ $\frac{4}{2}$ | 2 |
| Cascade ® detergent with 5% Polymer added | |
| $\frac{1}{1}$ $\frac{2}{1}$ $\frac{3}{1}$ $\frac{4}{1}$ | 1 |

EXAMPLE G—POWDERED LAUNDRY DETERGENTS INHIBITION OF INCRUSTATION

These tests were conducted under European laundry conditions using a Launder-O-Meter, which simulates a European type machine. The equipment is described in U.S. Pat. No. 4,559,159. The test conditions were: 60° C., 430 ppm hardness as $CaCO_3$, detergent concentrations of 1% and 0.6%. Four percent polymer was added to the detergent, which also contained 8% linear alkyl lauryl sulfonate, 4% sodium oleate, 20% tetrasodium pyrophosphate, 5% sodium silicate (2.4:1), 5% sodium carbonate, 20% sodium sulfate, 0.5% sodium carboxymethylcellulose, with the balance water.

Cotton terry cloth swatches were washed in the Launder-O-Meter cannisters for 10 cycles. A cycle consisted of one 20 minute soak, one 20 minute wash, and two 5 minute rinses. The swatches weighed about 25 gm and were washed in 100 gm of wash solution to give a 4:1 weight ratio of water to fabric. The fabric was then ashed at 800° C. for five hours and the incrustation was measured.

The results given in Table XI indicate that the polymer of the present invention is more effective in inhibiting encrustation than acrylic acid homopolymer.

TABLE XI

| Polymer | Comp. | Mw | Residual Ash Values Ash @ 1% det | Ash @ 0.6% det |
|---|---|---|---|---|
| None | — | — | 1.85% | 2.38% |
| Comparative Ex. 6 | AA | 4500 | 1.39% | 1.29% |
| Ex. 4 | AA/(EO 42 C 1) | 10000 | 1.35% | 1.06% |

The results given in Table X after one cycle show the advantage of the polymer of the present invention in the detergent with the glass ratings in spotting. The rating system is similar to the test method: 0—no spots, 1—spots barely perceptible, 2—slight spotting, 3—50% of the glass is covered with spots, and 4—the whole glass is covered with spots.

TABLE X

| Spotting on glass # | Grease Deposition |
|---|---|
| Cascade ® detergent alone | |
| $\frac{1}{2}$ $\frac{2}{2}$ $\frac{3}{2}$ $\frac{4}{2}$ | 2 |
| Cascade ® detergent with 5% Polymer added | |
| $\frac{1}{1}$ $\frac{2}{1}$ $\frac{3}{1}$ $\frac{4}{1}$ | 1 |

EXAMPLE G—POWDERED LAUNDRY DETERGENTS INHIBITION OF INCRUSTATION

These tests were conducted under European laundry conditions using a Launder-O-Meter, which simulates a European type machine. The equipment is described in U.S. Pat. No. 4,559,159. The test conditions were: 60° C., 430 ppm hardness as $CaCO_3$, detergent concentrations of 1% and 0.6%. Four percent polymer was added to the detergent, which also contained 8% linear alkyl lauryl sulfonate, 4% sodium oleate, 20% tetrasodium pyrophosphate, 5% sodium silicate (2.4:1), 5% sodium carbonate, 20% sodium sulfate, 0.5% sodium carboxymethylcellulose, with the balance water.

Cotton terry cloth swatches were washed in the Launder-O-Meter cannisters for 10 cycles. A cycle consisted of one 20 minute soak, one 20 minute wash, and two 5 minute rinses. The swatches weighed about 25 gm and were washed in 100 gm of wash solution to give a 4:1 weight ratio of water to fabric. The fabric was then ashed at 800° C. for five hours and the incrustation was measured.

The results given in Table XI indicate that the polymer of the present invention is more effective in inhibiting encrustation than acrylic acid homopolymer.

TABLE XI

| Polymer | Comp. | Mw | Residual Ash Values Ash @ 1% det | Ash @ 0.6% det |
|---|---|---|---|---|
| None | — | — | 1.85% | 2.38% |
| Comparative Ex. 6 | AA | 4500 | 1.39% | 1.29% |
| Ex. 4 | AA/(EO 42 C 1) | 10000 | 1.35% | 1.06% |

EXAMPLE H—CALCIUM CARBONATE INHIBITION

Using the procedure given in U.S. Pat. No. 4,326,980, inhibition of calcium carbonate formation by polymers of the present invention was measured. The results given in Table XII show that the polymers of the present invention are effective in inhibiting the formation of calcium carbonate, a useful property in both detergent and water treatment applications.

TABLE XII

| Example or Comparative Ex. | Polymer Composition | Polymer Molecular Weight | % Inhibition 2.5 ppm | 5 ppm | 10 ppm |
|---|---|---|---|---|---|
| Comp. Ex. 6 | AA | 2000 | 73.2 | 86.3 | 95.8 |
| — | Polymaleic[1] | 1000 | 66.9 | 77.9 | 84.8 |
| — | ATMP[2] | 299 | 79.5 | 82.1 | 81.6 |
| Ex. 20 | AA/(20 EO/ 16–18 C | 3500 | 46.9 | 58.4 | 73.7 |
| Ex. 32 | AA/(20 EO/ 16–18 C | 3700 | 27.9 | 51.2 | 64.2 |
| Comp. Ex. 5 | AA/(PEG 1000) | | 58.5 | 72.7 | 82.1 |

[1]Belclene TM (trademark of Ciba-Geigy) 200 - polymaleic acid.
[2]Dequest TM (trademark of Monsanto) 2000 aminotri(methylenephosphonic acid)

EXAMPLE I—DISPERSION OF KAOLIN CLAY

The ability of polymers of the present invention to dispens kaolin clay in an aqueous medium was measured as follows. 430 mls of 200 ppm $CaCO_3$ (Ca:Mg/2:1 as $CaCO_3$) and 0.43 gms Hydrite (trademark of Georgia Kaolin) UF kaolin (1000 ppm kaolin) were placed in a multimix cup and mixed for 10 minutes on a multimixer. The pH of the mixture was adapted to 7.5 with dilute NaOH. 100 ml aliquots of the mixture were then placed in 4 oz. jars; the mixture in the sampling 3jar being shaken after pouring ever other aliquot. 5, 10, and 20 ppm of polymer (0.5, 1, 2 ml of 0.1% solution adjusted to pH 8.0) were respectively added to each of three aliquots of kaolin/$CaCO_3$ mixture. The jars were shaken in a mechanical shaker for 15 minutes at low speed. After removing the jars from the shaker, they were allowed to stand on a still bench for 2 hours undisturbed. Without disturbing jars, the top 20 ml was removed and each sample was placed into a separate 1 oz. vial. The turbidity of each solution in the vials (0–1000 NTU) was read using a Fisher Turbidimeter Model DRT 100B.

The results given in Table XIII show that the polymers of the present invention are effective in dispersing koalin clay.

TABLE XIII

| Example | Polymer Composition | MW | Turbidity (NTU) 5 ppm | 10 ppm | 20 ppm |
|---|---|---|---|---|---|
| No polymer | | 42 | — | — | — |
| Comp Ex. 6 | AA | 4500 | 391 | 264 | 150 |

TABLE XIII-continued

| Example | Polymer Composition | MW | Turbidity (NTU) 5 ppm | 10 ppm | 20 ppm |
|---|---|---|---|---|---|
| Ex. 7 | AA/(40 EO/16–18 C) | 3500 | 481 | 614 | 867 |
| Ex. 8 | AA/(40 EO/16–18 C) | 10000 | 45 | 59 | 55 |
| Ex. 9 | AA/(40 EO/16–18 C) | 3500 | 205 | 986 | 1025 |
| Ex. 10 | AA/(40 EO/16–18 C) | 10000 | 120 | 703 | 946 |
| Ex. 11 | AA/(4 EO/12 C) | 3500 | 471 | 759 | 800 |
| Ex. 12 | AA/(4 EO/12 C) | 10000 | 58 | 46 | 44 |
| Ex. 3 | AA/(42 EO/1 C) | 3500 | 743 | 792 | 865 |
| Ex. 4 | AA/(42 EO/1 C) | 10000 | 234 | 186 | 143 |
| Ex. 19 | AA/(42 EO/1 C) | 3500 | 795 | 917 | 930 |
| Ex. 5 | AA/(42 EO/1 C) | 10000 | 801 | 906 | 768 |
| Ex. 13 | AA/(4 EO/12 C) | 3500 | 223 | 678 | 970 |
| Ex. 14 | AA/(4 EO/12 C) | 10000 | 46 | 66 | 88 |
| Ex. 15 | AA/(5 EO/8 C) | 3500 | 766 | 782 | 830 |
| Ex. 16 | AA/(5 EO/8 C) | 10000 | 491 | 489 | 304 |
| Ex. 17 | AA/(5 EO/8 C) | 3500 | 603 | 578 | 369 |
| Ex. 18 | AA/(5 EO/8 C) | 10000 | 320 | 344 | 219 |

EXAMPLE J—INHIBITIÓN OF BARIUM SULFATE FORMATION

The efficiency of polymers of the present invention in inhibiting the formation of barium sulfate was evaluated using the following procedure:

The following solutions were prepared:

| Formation Water | Sea Water* |
|---|---|
| 74.17 gm/l NaCl | 23.955 g/l NaCl |
| 10.31 gm/l $CaCl_2.2H2O$ | 1.57 g/l $CaCl_2.2H2O$ |
| 4.213 gm/l $MgCl_2.6H2O$ | 11.4362 g/l $MgCl_2.6H2O$ |
| 0.709 gm/l KCl | 0.8771 g/l KCl |
| 1.747 gm/l $SrCl_2.6H2O$ | 0.0243 g/l $SrCl_2.6H2O$ |
| 0.448 gm/l $BaCl_2.2H2O$ | 4.3769 g/l $Na_2SO_4$ |
| 0.0170 gm/l $Na_2SO_4$ | 0.1707 g/l $NaHCO_3$ |
| 0.638 gm/l $NaHCO_3$ | |

*Filtered through a 0.45 um filter

The pH of formation water and sea water were adjusted to pH 6 by bubbling nitrogen (to raise pH) or carbon dioxide (to lower pH) through the solutions. The pH of another sample was adjusted to 4 with carbon dioxide and concentrated HCl. For each test sample, the following compounds were placed in a clear 4 oz. jar:

1. Polymer dosage
   (1.3 ml of 0.1% polymer solution at pH 6)
   (3.9 ml of 0.1% polymer solution at pH 4)
2. 50 ml sea water
   (mix)
3. 50 ml formation water
   (mix)

The samples were placed in an oven at 90° C. for 15 hours, then filtered while hot through a 0.45 μm filter. The filtered samples were analyzed for Ca by EDTA titration and Ba and Sr by atomic absorption. Percent inhibition was calculated as follows.

$$\% \text{ inhibition} = \frac{(M)\text{sample} - (M)\text{blank}}{(M)100\% \text{ inhibition} - (M)\text{blank}} \times 100$$

TABLE XIV

| Example | Polymer Composition | Polymer Molecular Weight | % $BaSO_4$ Inhibition pH 4 30 ppm | pH 4 90 ppm | pH 6 10 ppm | pH 6 30 ppm |
|---|---|---|---|---|---|---|
| | no polymer | | 1 | | 0 | |
| Comp. | AA | 2000 | 4 | 7 | 6 | 35 |

TABLE XIV-continued

| Example | Polymer Composition | Polymer Molecular Weight | % $BaSO_4$ Inhibition pH 4 30 ppm | pH 4 90 ppm | pH 6 10 ppm | pH 6 30 ppm |
|---|---|---|---|---|---|---|
| Ex. 9 | | | | | | |
| Comp. Ex. 6 | AA | 4500 | — | — | 17 | 65 |
| Comp. Ex. 10 | AA/MAA[1] | 3500 | 7 | 9 | 3 | 45 |
| | DETPMP[2] | | 9 | 17 | 7 | 43 |
| Ex. 20 | AA/(20EO/16-18C) | 3500 | 24 | 32 | 22 | 60 |
| Comp. Ex. 5 | AA/(PEG 1000) | — | 5 | — | — | 3 |
| Ex. 32 | AA/(20EO/16-18C) | 3700 | 5 | — | — | 9 |
| Ex. 2 | AA/(20EO/16-18C) | | 30 | — | — | — |
| Ex. 3 | AA/(42EO/1C) | | 10 | — | — | — |
| Ex. 5 | AA/(42EO/1C) | | 9 | — | — | — |
| Ex. 7 | AA/(40EO/16-18C) | | 35 | — | — | — |
| Ex. 11 | AA/(4EO/12C) | | 24 | — | — | — |
| Ex. 13 | AA/(4EO/12C) | | 12 | — | — | — |
| Ex. 15 | AA/(5EO/8C) | | 29 | — | — | — |
| Ex. 17 | AA/(5EO/8C) | | 21 | — | — | — |
| Comp. Ex. 14 | AA | | 5 | — | — | — |
| Comp. Ex. 6 | AA | 4500 | 4 | — | — | — |
| Comp. Ex. 11[3] | AA/MAA[1] | | 7 | — | — | — |
| Comp. Ex. 13 | Poly(phosphino acrylic acid) | | 9 | — | — | — |
| Comp. Ex. 12[4] | Polystyrene sulfate | | 8 | — | — | — |

[1]acrylic acid/methacrylic acid copolymer.
[2]Dequest TM (trademark of Monsanto) 2060 - diethylene triamine
[3]Belsperse TM (trademark of Ciba-Geigy) 161 - poly(phosphino acrylic acid
[4]Versa TM (trademark of National Starch) TL-77 - polystyrene sulfonate The results reported in Table XIV show that copolymers of the present invention are effective in preventing the formation of barium sulfate under conditions encountered in oil wells. The polymers of the present invention are believed to be especially useful in carbon dioxide oilfield flooding and other oil recovery applications where the pH is low (e.g., around 4). Further, the polymers of the present invention are believed useful in redispersing barium sulfate in oil wells sealed with "scale" containing barium sulfate.

| Ion | Dilution | |
|---|---|---|
| Ca, Sr | 1.5 ml | 100 ml total |
| Ba | 6.0 ml | 100 ml total |
| Inhibition (calculated): | | |
| Ba | 126 ppm Ba = 214 ppm as $BaSO_4$ | |
| Sr | 291 ppm Sr | |
| Ca | 4043 ppm Ca as $CaCO_3$ | |

EXAMPLE K—COAL DISPERSANCY

The efficiency of polymers of the present invention in dispersing coal to form a 70% slurry was measured according to the following procedure.

200 gm Pittman Moss #1 coal were weighed out and 85.7 gm dispersant (2% or 3% solution depending on desired concentration of dispersant solids) plus 3gm of deionized water were added directly into a one-quart stainless steel multimixer blender cup. The coal was transferred to the cup and mixed by hand with a large stainless steel spatula until all the coal was wetted. The mixture was blended down using a Multimeter TM (trademark of Sterling Multi-Products, Inc.) mixer in a hood. Initially the mixture was advanced by hand. The cup was slowly moved while activating the ON button so that mixture flowed uniformly. The cup was then in position and the contents were mixed for 20 minutes. The progress was checked every 5 minutes and the mixture was hand blended if necessary. After mixing, the temperature was measured immediately and quickly viscosity at rpm of 10, 20, 100, 20, 10 using spindle #5 with a Brookfield RVT viscometer.

The results given in Table XV show that the polymers of the present invention were more effective in dispersing coal to form a 70% slurry than naphthalene sulfonate dispersant or acrylic acid homopolymer.

TABLE XV

| Example or Comp. Example | Additive Composition | Level (on coal) | MW | Viscosity[1] RPM:10 | 20 | 100 | 20 | 10 |
|---|---|---|---|---|---|---|---|---|
| Comp. Ex 6 | AA | 1.0% | 4500 | Failed - Not fluid | | | | |
| | napthalene sulfonate | 1.0% | | 1720 | 1720 | 1556 | 1140 | 1140 |
| | napthalene sulfonate | 1.5% | | 1800 | 1600 | 1458 | 1210 | 1260 |
| 1 | AA/(20 EO/16-18 C) | 1.0% | 7640 | 1873 | 1333 | 783 | 933 | 1233 |
| 1 | AA/(20 EO/16-18 C) | 1.5% | " | 1287 | 1060 | 782 | 827 | 1007 |
| 2 | AA/(20 EO/16-18 C) | 1.0% | 3350 | 1700 | 1153 | 694 | 880 | 1033 |
| 2 | AA/(20 EO/16-18 C) | 1.5% | " | 1427 | 933 | 503 | 690 | 800 |
| 5 | AA/(42 EO/1 C) | 1.0% | 3810 | 1133 | 957 | 507 | 607 | 620 |
| 5 | AA/(42 EO/1 C) | 1.5% | " | 780 | 607 | 320 | 327 | 373 |
| 9 | AA/(40 EO/16-18 C) | 1.0% | 2950 | 2173 | 1537 | 909 | 1097 | 1413 |
| 9 | AA/(40 EO/16-18 C) | 1.5% | " | 867 | 710 | 412 | 520 | 613 |

[1]Measured using a Brookfield RVT viscometer equipped with a number 5 spindle and reported as a function of the anguilar speed of the spindle.

EXAMPLE L—ENZYME STABILITY

Commercial heavy duty detergent compositions may contain protease to aid cleaning by digesting protein stains. The compatibility of polymers of the present invention with proteases used in detergent compositions was evaluated using a procedure recommended by the enzyme supplier, Novo Enzyme Co. given in L. Kravetz et al., *J.A.O.C.S.*, 62 (1985) 943-949.

To determine the proteolytic activity of alkaline proteases, a protease was allowed to hydrolyze azocasein for 30 minutes at 40° C. Undigested protein was precipitated with trichloroacetic acid and the quantity of digested product was determined by spectrophotometry.

Using this procedure, the enzymatic activity of several proteases in a commercial heavy duty liquid detergent compositio containing a water soluble polymer of the present invention were measured as a function of time and compared with like data from control detergents.

The results given in Table XVI show that polymers of the present invention are compatible with liquid detergent composition containing proteases and do not inhibit their enzymatic activity.

TABLE XVI

| Additive[1] | Relative Activity (average of duplicates) Initial | 1 wk | 2 wk | 3 wk | 8 wk |
|---|---|---|---|---|---|
| alcalase | 1.0 | .95 | .78 | .98 | .84 |
| alcalase + 1.5% Example 21 | .99 | 1.1 | .75 | .82 | .85 |
| savinase | 8.1 | 7.6 | 7.8 | 7.9 | 7.7 |
| savinase + 1.5% Example 21 | 8.8 | 7.7 | 8.6 | 9.0 | 8.3 |
| esperase | 3.4 | 3.3 | 2.8 | 2.8 | 2.9 |
| esperase + 1.5% Example 21 | 3.7 | 3.1 | 3.7 | 3.6 | 3.1 |

[1]Detergent: Commercial detergent Tide ® (trademark of Procter and Gamble Company) (neat) with enzymes added at 0.6%. Enzymes supplied by NOVO Industries. Test solutions stored at room temperature Various modifications can be made in the details of the various embodiments of the present invention described above, all within the spirit and scope of the invention as defined in the appended claims.

We claim:

1. A detergent composition containing a surfactant selected from the group consisting of anionic, nonionic, and cationic surfactants and mixtures thereof and including a water soluble polymer, the water soluble polymer being selected from (a) polymers of acrylic and methacrylic acid esters of an alkyl polyalkylene oxide, alkylpolyalkylene oxide of urethanes or containing alkylpolyalkylene oxide thio end groups, said polymers having the formula $$A\ (B)_m\ (C)_n\ (D)_o\ E,$$

(1) A being a group selected from $$R^b—C(O)—R^a— \text{ and } R^c—C(O)NH—R^d—;$$

$R^a$ being selected from $(C_2-C_5)$alkylidene and $(C_2-C_5)$alkylidene derivatives including a chain initiator or chain transfer radical;

$R^b$ being selected from —OQ and $R^c$;

$R^c$ having the formula $$R^1\ Z\ (X^1)a\ (X^2)b—;$$

$R^1$ being selected from $(C_1-C_{18})$alkyl, $(C_1-C_{18})$alkaryl, and $(C_1-C_{18})$aralkyl;

Z being selected from —O—, —S—, —$CO_2$—, —$CONR^2$—, and —$NR^2$—;

$X^1$ being —$CH_2CH_2O$—;

$X^2$ being —$C(CH_3)HCH_2O$—;

a being a positive integer and b being a non-negative integer, the sum of a and b being from 3 to about 100, it being understood that the $X^1$ and $X^2$ units can be arranged in any sequence;

$R^2$ being selected from H, $(C_1-C_4)$alkyl, and $H(X^1)d(X^2)_e$—; d and e being nonnegative integers, the sum of d and e being from 1 to about 100;

Q being selected from H and the positive ions forming soluble salts with carboxylate anions;

$R^d$ being a group which includes a carbon-carbon single bond formed during polymerization of the polymer from a polymerizable carbon-carbon double bond;

(2) B having the formula $$—\overset{|}{R^e}—C(O)—OQ,$$

$R^e$ being a saturated trivalent aliphatic group having from two to five carbon atoms (3) C being selected from $$—\overset{|}{R^e}—R^c,\ —\overset{|}{R^f}—NHC(O)—R^c \text{ and } —\overset{|}{R^e}—C(O)—R^c,$$

$R^f$ being a group which includes a carbon-carbon single bond formed during polymerization of the polymer from a polymerizable carbon-carbon double bond;

(4) D having the formula $$—\overset{|}{R^e}—G$$

wherein G is an organic group excluding Rc and —$CO_2Q$;

(5) E being a group selected from $$R^c—R^g—,\ R^b—C(O)—R^g— \text{ and } R^c—C(O)NH—R^d—,$$

$R^g$ being selected from $(C_2-C_5)$alkylene and $(C_2-C_5)$ alkylene derivatives including a chain transfer radical;

m being a positive integer and n and o being non-negative integers, m being selected such that $(B)_m$ comprises from about 20 to percent by weight of the polymer, n being selected such that $R^c$ comprises from about 80 to 5 percent by weight of the polymer, o being selected such that $(D)_o$ comprises from zero up to about 30 percent by weight of the polymer, the sum of the weight percentages of A, $(B)_m$, $(C)_n$, $(D)_o$ and E being 100 percent, it being further understood that the B, C, and D groups can be arranged in any sequence;

and the polymer having a number-average molecular weight from about 500 to 50,000; and (b) polymers having the formula L-J, L— having the formula $R^c—C(O)(CHR^3)_c—S—$, —J having the formula—$(B)_m(D)_oE$, the subscript c being selected from 1, 2, and 3, $R^3$ being selected from H—, $CH_3$—, and $C_2H_5$—, the weight ratio of L to J being from about 1:340 to 7:1, o being selected such the $(D)_o$ comprises up to about 40 percent by weight of the polymer, and the sum of m and n being from about 10 to 500.

2. A detergent composition according to claim 1 wherein (1) A is selected from $$CH_3—\overset{|}{CH}—C(O)—OQ \text{ and } CH_3—\overset{|}{C(CH_3)}—C(O)—R^c;$$

(2) B is a group having the formula $$-CH_2\overset{|}{C}H-C(O)-OQ;$$

(3) C is a group having the formula $$-CH_2\overset{|}{C}(CH_3)-C(O)-R^c; \text{ and}$$

(4) E is selected from $$-CH_2-CH_2-C(O)-OQ \text{ and}$$
$$-CH_2-CHCH_3-C(O)-R^c.$$

3. A detergent composition according to claim 2 wherein the polymer includes $R^c$ groups having the formula $R^1O(X^1)a-$ wherein $R^1$ is $(C_1-C_{18})$alkyl, and a is from about 5 to 45.

4. A detergent composition according to claim 3 wherein $R^1$ is $(C_{10}-C_{18})$alkyl.

5. A detergent composition according to claim 4 wherein the number average molecular weight of the polymer is from about 1000 to 5000.

6. A detergent composition according to claim 1 wherein the water soluble polymer has the formula L-J, the sum of m and o being from about 20 to 150.

7. A detergent composition according to claim 1 wherein the water soluble polymer is selected from polymers having the formula L-J, the weight ratio of L to J being from about 1:100 to 2:1.

8. A detergent composition according to claim 1 wherein G is selected from $-NH_2$, $-NHR^3$, $-OR^3$, $-OR^4-OH$, $-OR^4NH$, $-OR^4-SO_3Q$, $-OR^4-PO_3Q$, $R^3$ being $(C_1-C_8)$alkyl, and $R^4$ being $(C_1-C_8)$alkylene.

9. A detergent composition according to claim 1 wherein $R^d$ is alpha,alpha - dimethyl-meta-isopropenyl benzyl.

10. A detergent composition according to claim 1 wherein the number average molecular weight of the polymer is from about 1,000 to 15,000.

11. A detergent composition according to claim 1 wherein the composition is liquid.

12. A detergent composition according to claim 1 wherein the detergent components are selected to provide a heavy duty detergent composition adapted to launder textiles.

13. A detergent composition according to claim 1 wherein the detergent components are selected to provide a light duty detergent composition adapted to hand dishwashing.

14. A detergent composition according to claim 1 wherein the detergent components are selected to provide a liquid composition adapted for machine dishwashing.

15. A process for cleaning textiles comprising washing a textile fabric in a detergent composition according to claim 1.

16. A process for cleaning hard surfaces comprising washing an article having a hard surface with a detergent composition according to claim 1.

* * * * *

UNITED STATES PATENT AND TRADEMARK OFFICE

CERTIFICATE OF CORRECTION

PATENT NO. : 4,797,223

DATED : January 10, 1989

INVENTOR(S) : David R. Amick et al.

It is certified that error appears in the above-identified patent and that said Letters Patent is hereby corrected as shown below:

Col. 2, line 55 - The word "ove" should read --over--

Col. 4, line 23 - The word "whiCh" should read --which --

Col. 4, line 64 - Delete the word "15"

Col. 5, line 67 - The chemical compound "Rg" should read -- $R^g$ --

Col.10, line 61 - The chemical compound "-CQ" should read -- OQ --

Col.16, line 34 - The word "aoounts" should read -- amounts --

Col.17, line 64 - Add a period after the word "like"

Col.23, line 29 - The word "(ethyleneoxy)19" should read

--$(ethyleneoxy)_{19}$ --

Col.23, line 64 - The word "(ethyleneoxy)19" should read

-- $(ethyleneoxy)_{19}$

Col.27, Table VI - Footnote No.1 "Bleaches" should read -- Bleached --

Col.31, line 37 - The word "dispens" should read -- dispense --

Col.31, line 45 - The word "3jar" should read -- jar --

UNITED STATES PATENT AND TRADEMARK OFFICE

CERTIFICATE OF CORRECTION

PATENT NO. : 4,797,223

DATED : January 10, 1989

INVENTOR(S) : David R. Amick et al.

It is certified that error appears in the above-identified patent and that said Letters Patent is hereby corrected as shown below:

Col.33, line 51 to 68
Col.34, line 1 to 3 - Should follow calculations in Col. 32, line 60

Col.33, line 24 - Table XIV - "AA/MAA' Ex.11[3]" should read

-- AA/MAA' Ex. 13 --

Col.33, line 26 - Table XIV - "Poly(phosphino acrylic acid Ex. 13" should read

-- Poly(phosphino acrylic acid Ex. 11[3]

Col.34, line 67 - The word "compositio" should read -- composition --

Claim 1 - Col.36, line 38 - The sentence "comprises from about 20 to percent" should read -- comprises from about 20 to 95 percent --.

Claim 1 - Col. 35, line 62 - The composition "$H(X^1)d(X^2)_e$" should read -- $H(X^1)_d(X^2)_e$ --.

Signed and Sealed this

Twenty-seventh Day of June, 1989

*Attest:*

DONALD J. QUIGG

*Attesting Officer*

*Commissioner of Patents and Trademarks*